United States Patent [19]

Hastings

[11] 4,449,764

[45] May 22, 1984

[54] DATA PROCESSING EQUIPMENT ENCLOSURES

[75] Inventor: Otis H. Hastings, Mahwah, N.J.

[73] Assignee: Transaction Security, Inc., Montvale, N.J.

[21] Appl. No.: 282,708

[22] Filed: Jul. 13, 1981

Related U.S. Application Data

[60] Continuation-in-part of Ser. No. 119,816, Feb. 8, 1980, abandoned, which is a continuation of Ser. No. 1,264, Jan. 5, 1979, abandoned, and a continuation-in-part of Ser. No. 952,782, Oct. 19, 1978, Pat. No. 4,348,966, which is a division of Ser. No. 827,593, Aug. 25, 1977, Pat. No. 4,121,523, which is a continuation-in-part of Ser. No. 602,404, Aug. 7, 1975, abandoned, and a continuation-in-part of Ser. No. 825,174, Aug. 16, 1977, abandoned, which is a continuation of Ser. No. 602,404, Aug. 7, 1975, abandoned.

[51] Int. Cl.[3] ..... A47B 77/08; F25D 23/12

[52] U.S. Cl. ..... 312/236; 312/31; 312/312; 312/223; 261/30; 261/106; 62/337; 34/15

[58] Field of Search ..... 312/236, 223, 125, 135, 312/305, 31, 31.01-31.06, 312; 34/15, 201, 227, 243 R; 261/30, 106; 62/337; 109/2, 4, 7, 48

[56] References Cited

U.S. PATENT DOCUMENTS

| | | | |
|---|---|---|---|
| 60,191 | 12/1866 | Horn | 109/48 |
| 1,419,960 | 6/1922 | Dell | 109/4 |
| 1,556,711 | 10/1925 | Pietrzycki | 312/312 |
| 1,579,560 | 4/1926 | Moore | 312/31.03 |
| 1,924,365 | 8/1933 | Mariotti | 312/33 |
| 2,081,271 | 5/1937 | Ellithorpe | 109/7 |
| 2,432,736 | 12/1947 | Elkins | 312/31 |
| 2,436,569 | 2/1948 | Halter | 312/33 |
| 2,539,587 | 1/1951 | Morse et al. | 312/31 |
| 2,561,517 | 7/1951 | Ladge | 312/31 |
| 2,593,233 | 4/1952 | White | 312/196 X |
| 2,740,684 | 4/1956 | Haralson | 312/223 |
| 2,984,194 | 5/1961 | Jennings | 109/4 |
| 2,987,357 | 6/1961 | Kinsing et al. | 312/223 |
| 3,033,633 | 5/1962 | Holloway et al. | 312/236 |
| 3,055,319 | 9/1962 | Asprion nee Goerz | 109/12 |
| 3,065,037 | 11/1962 | Chapman | 312/312 |
| 3,327,092 | 6/1967 | Wilson | 312/236 |
| 3,503,136 | 3/1970 | Fleissner | 34/15 |
| 3,514,771 | 5/1970 | Ehalt et al. | 312/236 |
| 3,718,485 | 2/1973 | Lankford | 34/15 |

FOREIGN PATENT DOCUMENTS

| | | | |
|---|---|---|---|
| 12530 | of 1914 | United Kingdom | 312/223 |
| 1467369 | 3/1977 | United Kingdom | 49/41 |

*Primary Examiner*—Victor N. Sakran
*Attorney, Agent, or Firm*—Daniel J. Reardon

[57] ABSTRACT

A transaction processing enclosure for housing of electronic data processing equipment and the like, comprising a frame rack assembly formed of hollow conduit support members, arranged at spaced intervals to provide a unitary support structure adapted to receive and store electronic data processing equipment and the like; the hollow support members being interconnected to permit distribution of a fluid thereto with emission therefrom along the course of the hollow support members into the enclosure in combination with a turntable mounted to support the frame rack assembly and affect rotation thereof within said enclosure.

33 Claims, 14 Drawing Figures

FIG. 5
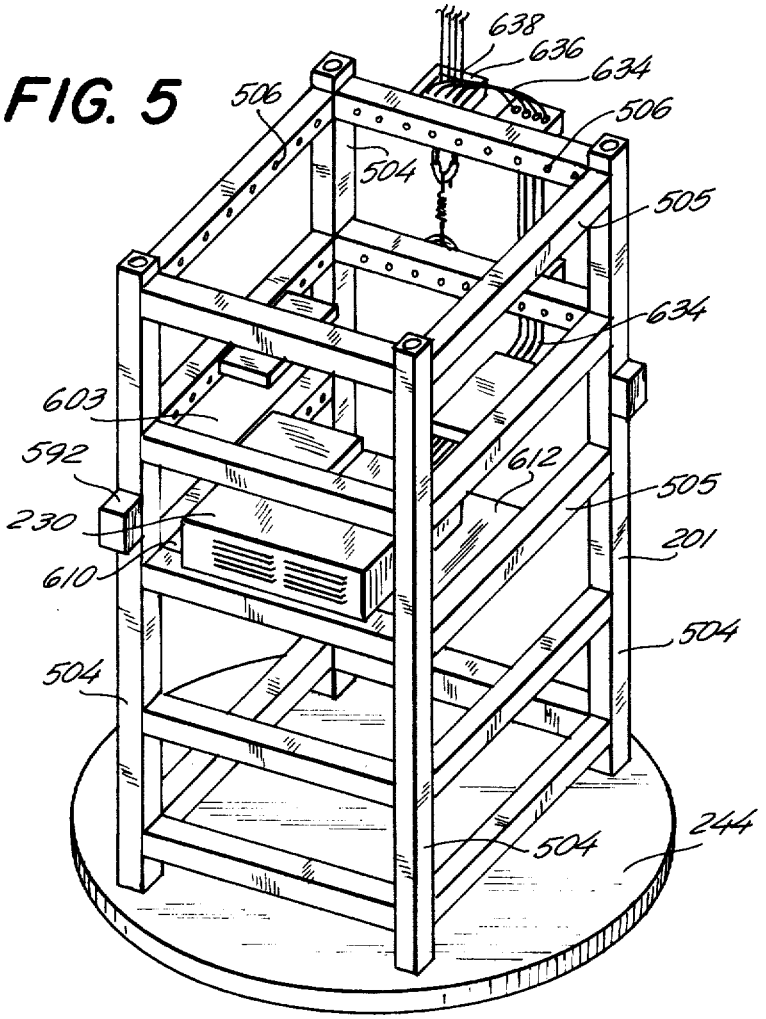
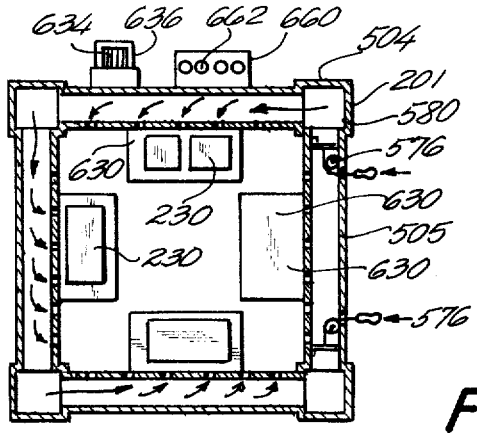
FIG. 6

FIG. 7
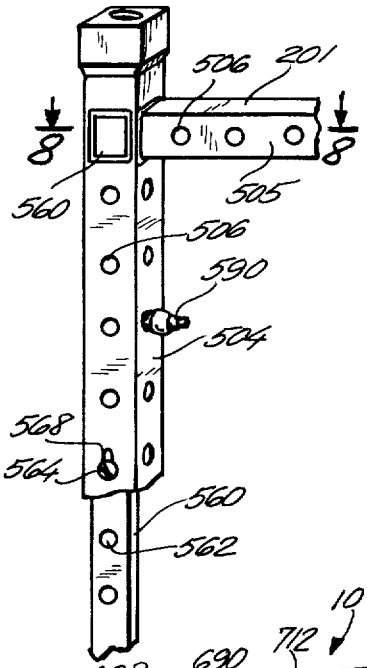
FIG. 8
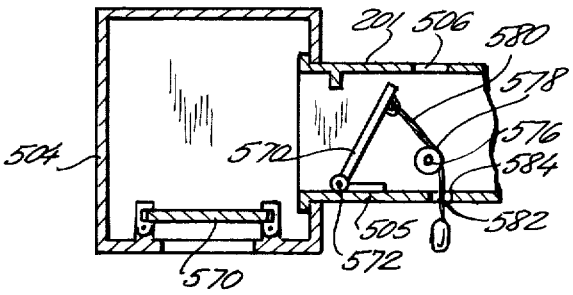
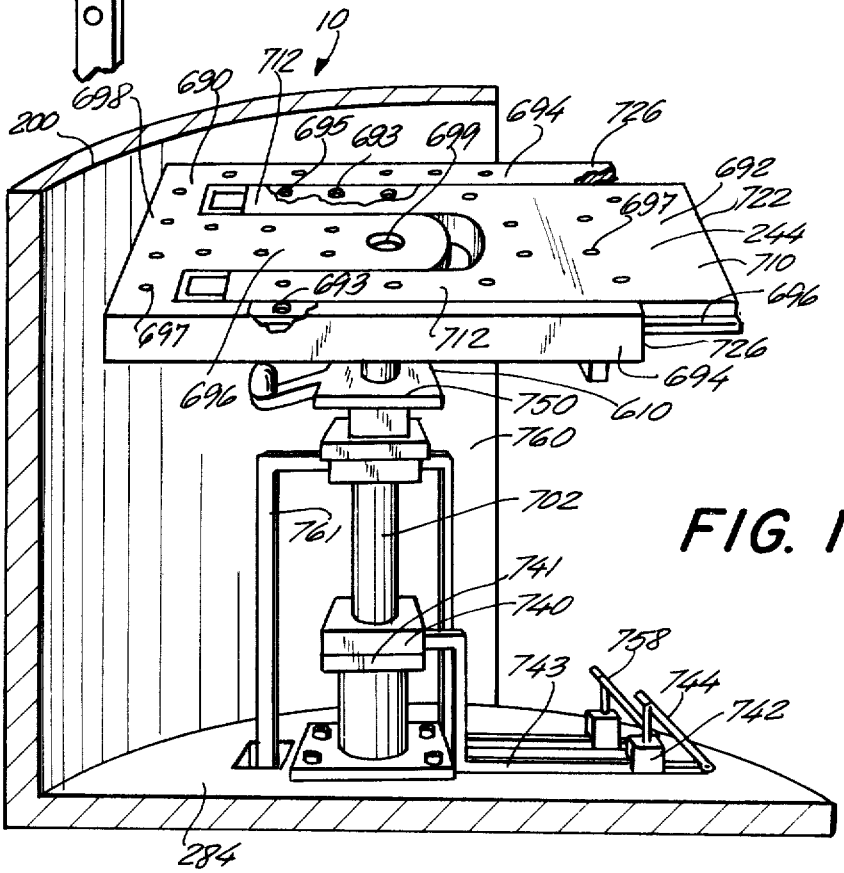
FIG. 10

DATA PROCESSING EQUIPMENT ENCLOSURES

CROSS REFERENCE TO RELATED APPLICATIONS

This application is a continuation-in-part of copending application Ser. No. 119,816 filed Feb. 8, 1980 (now abandoned); which is, in turn, a continuation of application Ser. No. 1,264 filed Jan. 5, 1979 (now abandoned). The present application is also a continuation-in-part of copending application Ser. No. 952,782 filed Oct. 19, 1978 (now U.S. Pat. No. 4,348,966), which is a divisional application of application Ser. No. 827,593 filed Aug. 25, 1977 (now U.S. Pat. No. 4,121,523); and which latter application is, in turn, a continuation-in-part of application Ser. No. 602,404 filed Aug. 7, 1975 (now abandoned) and a continuation-in-part of application Ser. No. 825,174 filed Aug. 16, 1977 (now abandoned); the latter a continuation application of said application Ser. No. 602,404.

TECHNICAL FIELD

This invention pertains to an enclosure providing a controlled environment and access to equipment contained therein.

BACKGROUND ART

Single or multiple component electronic data processing apparatus or other specialty equipment used separately or in support or cooperation with a manual transaction system or automatic transaction equipment requires, normally, a closely controlled environment in which to function efficiently over a sustained period of time. This environment has been provided usually, heretofore, by placing all of an organization's data processing apparatus except, for example, remotely disposed terminals and the like, in a single large room where overall conditions are maintained substantially uniform. To accomplish this is expensive, the location of the equipment is often inconvenient and an accommodation to necessity rather than efficient utilization; and a power failure or the like will necessitate, in the absence of an auxiliary power supply, a shut-down of an organization's entire electronic data processing system; and in modern terms where banks are concerned, for example, will cause a closing of the entire business enterprise, as well as other enterprises dependent upon it. This vulnerability exists as well with sensitive government installations and will ordinarily disconnect and disarm the protective systems and apparatus used to secure the electronic data processing system itself against injury.

Physical security of the electronic data processing apparatus or other transaction processing equipment against vandalism and misuse is also a material concern. Resort has been had to automated equipment mounted in unprotected stations on building exteriors, for example, in the belief that they were invulnerable to harm or unauthorized exploitation. This assessment has proven to be in error as these devices have been frequently pummeled and damaged with expensive equipment replacement costs.

In addition, insofar as devices of this sort are automatic paying or receiving machines coming under the authority of governmental regulations, such as those in the United States of America of the U.S. Federal Reserve Board, they are required to meet the several regulatory construction requirements of Regulation P (12 CFR 216); and, once installed, have not been capable of ready removal or relocation.

Electronic data processing equipment has characteristically been disposed in cabinets about which snap-on metal panels are mounted that serve few functions other than aesthetically covering the data processing components of the system and, in some instances, protecting the contained equipment from incidental damage from light or casual impact.

The shelves and support members within the cabinet upon which the foregoing components rest is usually made of heavy gauge metal and adapted solely to support the components within the cabinet. Cables attached to the components, whether employed to deliver power or to transmit communications signals to and from the components, have characteristically been partially fastened in the cabinet interior without any particular order or organization.

Further, the cabinet skin or covering tends to lead to undesired confinement at high temperatures within limited areas about the equipment components, since these components of the cabinet characteristically generate a considerable amount of heat during normal operation and require air flow from a variety of directions for cooling purposes and since air flow is usually and inherently from the base of the cabinet up through the components as a result of which it is normally necessary to allow large amounts of open space above and beneath the components as well as furnishing small blowers to encourage the intake of temperature and humidity regulated air from the surrounding room or more frequently, from an air supply plenum under a raised floor system.

The use of a transaction processing unit such as described in my U.S. Pat. No. 4,121,523 or one such as described in copending application Ser. No. 102,552 filed Nov. 11, 1979 and incorporated by reference herein or application Ser. No. 912,974 filed June 5, 1978 and also incorporated by reference herein to house data processing equipment, including banking data processing equipment and related devices, obviates the need of providing temperature and humidity controlled air to an entire, large, specially built room or facility to supply and sustain a stable defined environment about the data processing equipment contained therein. Temperature and humidity-controlled air or other atmosphere may be provided to the data processing equipment using the air supply present in the facility or room in which said data processing equipment is housed or from an air conditioning unit dedicated to that purpose. Air circulation through the transaction processsing unit or data processing equipment enclosure is provided by perforation of the opposite ends or side walls of the enclosure housing using normally a blower or fan assembly to encourage the flow of air therethrough.

Even where a fan or blower is used, however, the tendency is for development of a gradient temperature to occur within the housing; warm air at the top and cooler air at the bottom; and while the limited space involved permits for ready adjustment, difficulty in making the adjustment uniform, or uniform over a sustained period throughout the unit still exists, an aspect significant particularly where the data processing equipment is tiered vertically within the enclosure. Such a tiered arrangement permits, however, a significantly more efficient use of the enclosure.

Rotation of data processing equipment either within or immediately outside the foregoing data processing equipment enclosures to provide access to the various aspects thereof eliminates the need for access space about the entire periphery of the enclosure. The cables attached to the data processing or similar equipment within the enclosure, either for the purpose of supplying electrical power thereto or for the purpose of communication with and between the various components of a data processing system, may be rotated with the equipment, provided sufficient slack is permitted to allow rotation or movement without placing tension or stress upon the cables.

Rotation of the data processing equipment within the enclosure is described in the foregoing U.S. Pat. No. 4.121,523 and pending application Ser. Nos. 952,782 and 102,552 and is also, as indicated, particularly advantageous in permitting access to the equipment for operation or servicing thereof through the same aperture, or at least through a limited aspect of one side of the housing, accomplishing an economy of movable parts, function and space while limiting the communication between the exterior and interior of the enclosure, consistent with its maximum and most advantageous utilization. Where rotation is unlimited and tiered data processing equipment or the like is contained in the enclosure the utilization of this space becomes involved, by way of illustration, when a plurality of cables are present, and these will often number in excess of about two hundred. The identity and function of these cables may become confused, and the cables entangled or twisted through careless or improper operation of the data processing equipment enclosure housing said equipment.

However, if support means for electronic data processing equipment could be provided that serves as a fluid distribution system, alone or in combination with a further duct system, within, or within and exterior, to said enclosure for transmission and direction of a fluid, such as air, the temperature and humidity or which is controlled, to the various aspects of the enclosed data processing equipment requiring a consistent and modulated environment, while ordering the distribution and controlling the slack length and tension of the cables of the enclosed data processing equipment, a significant advance in the state of the art would be attained. Further, in the event the foregoing support and fluid distribution means could be integrated in the foregoing enclosure to rotate in a carefully defined arc and upon the axis of said support and distribution means so that ready access could be had to any aspect, and particularly any lateral aspect, of the data processing equipment or the like mounted upon the foregoing support and distribution means through a single aperture or a plurality of superimposed apertures at a single point in, or portion of, the periphery of said enclosure, a further material step forward in the state of the art would be affected.

Any material contraction in size of the enclosure accomplished at either end and circumferentially permitting increased utilization of space with provision simultaneously for security against both fire and vandals, for uniform atmosphere conditions throughout the enclosure such as will permit incorporation thereof in conventional desks, clerical work stations and areas for containment of terminals, microcomputers and data storage and retrieval devices, and permit ready movement and convenient location, will manifestly provide a still further and significant advance in the relevant art.

DISCLOSURE OF THE INVENTION

It is, accordingly, an object of this invention to provide a rack assembly for use in an enclosure means adapted to contain a variety of equipment, and particularly data processing equipment, in which the temperature and humidity throughout the enclosure may be maintained at a substantially uniform level or varied selectively to accommodate different equipment disposed within disparate parts of the same enclosure.

It is a further object of this invention to provide ventilation, temperature and humidity control means as aforesaid, in combination with support means for said equipment in a tiered assembly within said enclosure.

It is still a further object of this invention to provide a fluid distribution and support system that includes means for systematically distributing the cable systems of data processing equipment present in the foregoing enclosures with integrated cable length and tension control means to avoid twisting and entanglement of the various cables defining entry into the enclosure.

In accordance with the present invention, an improved enclosure is provided for the housing and maintenance of apparatus, and particularly electronic data processing equipment under selectively controlled environmental conditions in a physically secure state and in a compact, efficient and yet readily accessible manner subject to convenient transport from one location to another. The enclosure or module of the invention is, in a particularly preferred embodiment, thermally insulated, and includes a stationary wall or housing, a ceiling and floor forming the opposite closed ends of said housing, at least one access means to the interior of the enclosure, closure means registrable with said access means; and a rack assembly disposed within said housing adapted to receive a plurality of electronic data processing components in a multi-tiered manner therein and comprising a plurality of tubular legs and affixed thereto, a plurality of connecting tubular rib support members, the interior of said leg and rib support members, being selectively continuous with one another. The tubular members of the rack assembly are connected, normally through the ceiling and a supra modular housing disposed thereon or through the floor of the enclosure to a ventilation, air-conditioning and humidity control system. The rack assembly in addition, to supporting a plurality of data processing components, for example, sensitive to contaminants, temperature, humidity and the like, receives the emissions of the foregoing systems for circulation throughtout the interior of the enclosure. The tubular elements of the rack assembly have a plurality of groups of spaced apertures or vents having vent closure means adapted for emission of a controlled atmosphere at discretionary rates into the interior of the module or enclosure at various points and levels therein.

The tubular members may include resistance, heating or other heating or cooling jackets or elements along their interior passageways to affect the temperature and relative humidity of particular zones of the enclosure's interior. At the same time several of the tubular elements may have separate access to separate ventilating and air-conditioning sources outside of the enclosure. In addition, the tubular conduit elements may serve solely for the transmission of fluid or atmosphere and non-transmitting structural elements may support said equipment, however, this embodiment is, in general, significantly less preferred. In one embodiment of the invention the module of the invention includes turntable means, in the form of one or a plurality of plates or platforms disposed within the enclosure upon which the tubular rack assembly is mounted. In one such embodiment the turntable is disposed illustratively in contiguous relation to the inner circumference of the enclosures. Atmospheric venting and collection means are provided in the ceiling and supra module housing.

The turntable provides easy access to the rear or any other aspect of the data processing equipment mounted on the rack assembly of the module's interior, as it is readily rotated by manual rotation or suitable electrical or electronic means or the like well known to those skilled in the art, through a single access means in the enclosure wall or housing or, in an alternative less preferred embodiment, a plurality of access means. Other embodiments, including in addition, although less preferred for a number of purposes, the entire apparatus may be extended out of the access means for service and, in addition, rotated while extended from the housing if required.

The distribution of cable and wiring entering the enclosure to operate the data processing apparatus components mounted within are controlled and integrated with the rack by cable distribution and control means integrated with the rack assembly.

BRIEF DESCRIPTION OF DRAWINGS

The foregoing and additional objects, features and advantages of this invention will be apparent to those skilled in the art from the following detailed description of the preferred embodiments of the invention when taken in conjunction with the accompanying drawings in which:

FIG. 5 is a perspective view showing the rack assembly of FIG. 1 removed from the enclosure, with data processing components shown schematically positioned thereon.

FIG. 6 is a horizontal cross-sectional view of the isolated rack assembly component taken along the lines 6—6 of FIG. 5.

FIG. 7 is a fragmentary side elevational view of the nexus of horizontal and vertical members of the rack assembly component of FIG. 5.

FIG. 8 is a horizontal cross-sectional view taken along the lines 8—8 of FIG. 7.

FIG. 10 is a fragmentary perspective view of the enclosure of FIG. 1 incorporating a rotatable platform adapted to receive the rack assembly components of FIGS. 1 and 2.

BEST MODE FOR CARRYING OUT THE INVENTION

Figure 1:
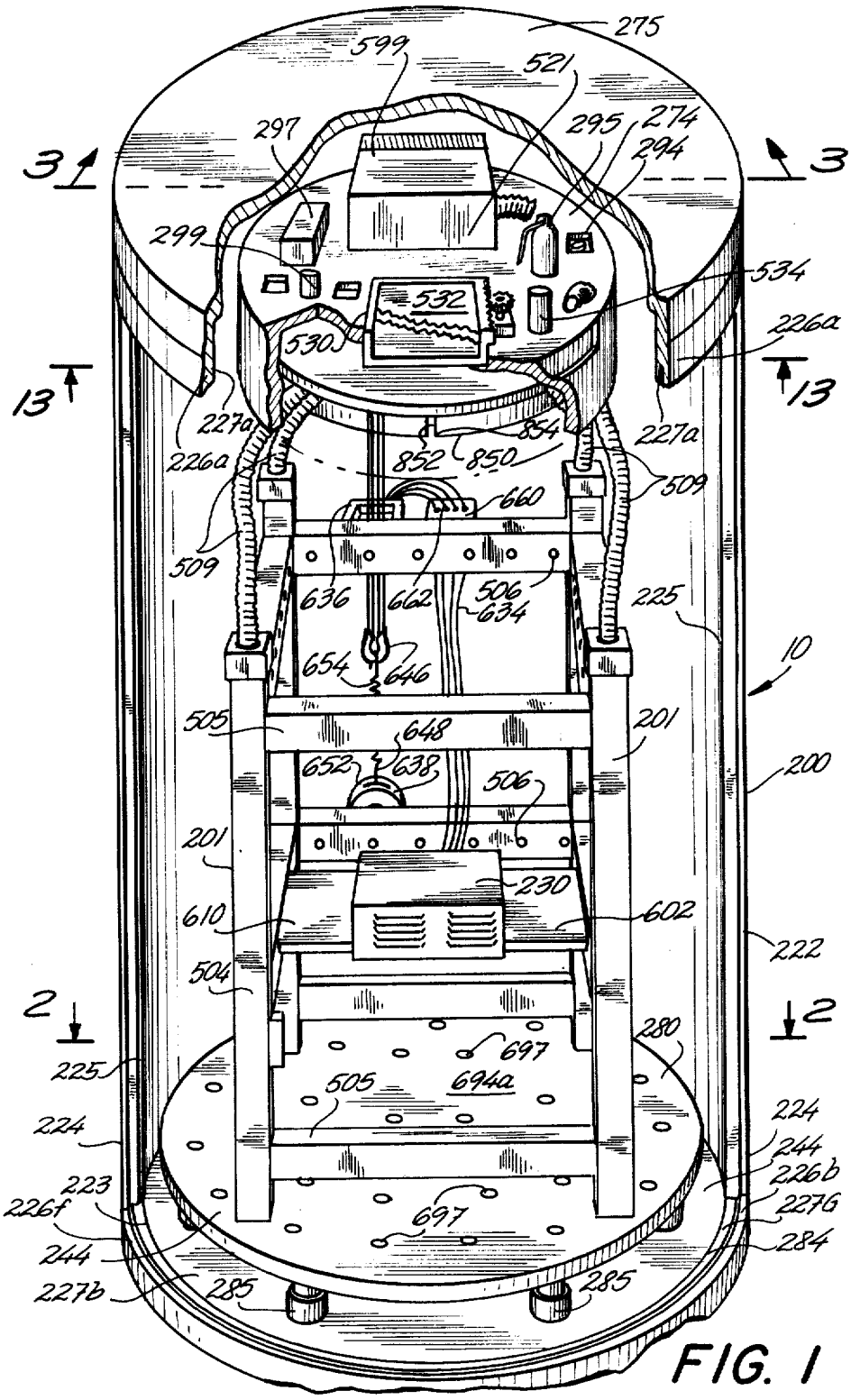
FIG. 1 is a perspective view of the rack assembly enclosure of the invention with a portion broken away.
Figure 2:
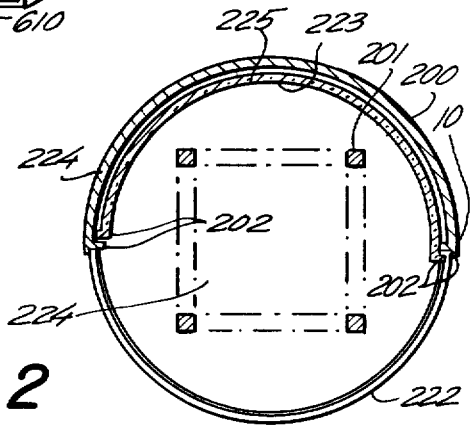
FIG. 2 is a horizontal sectional view taken along the lines 2—2 of FIG. 1.
Figure 3:
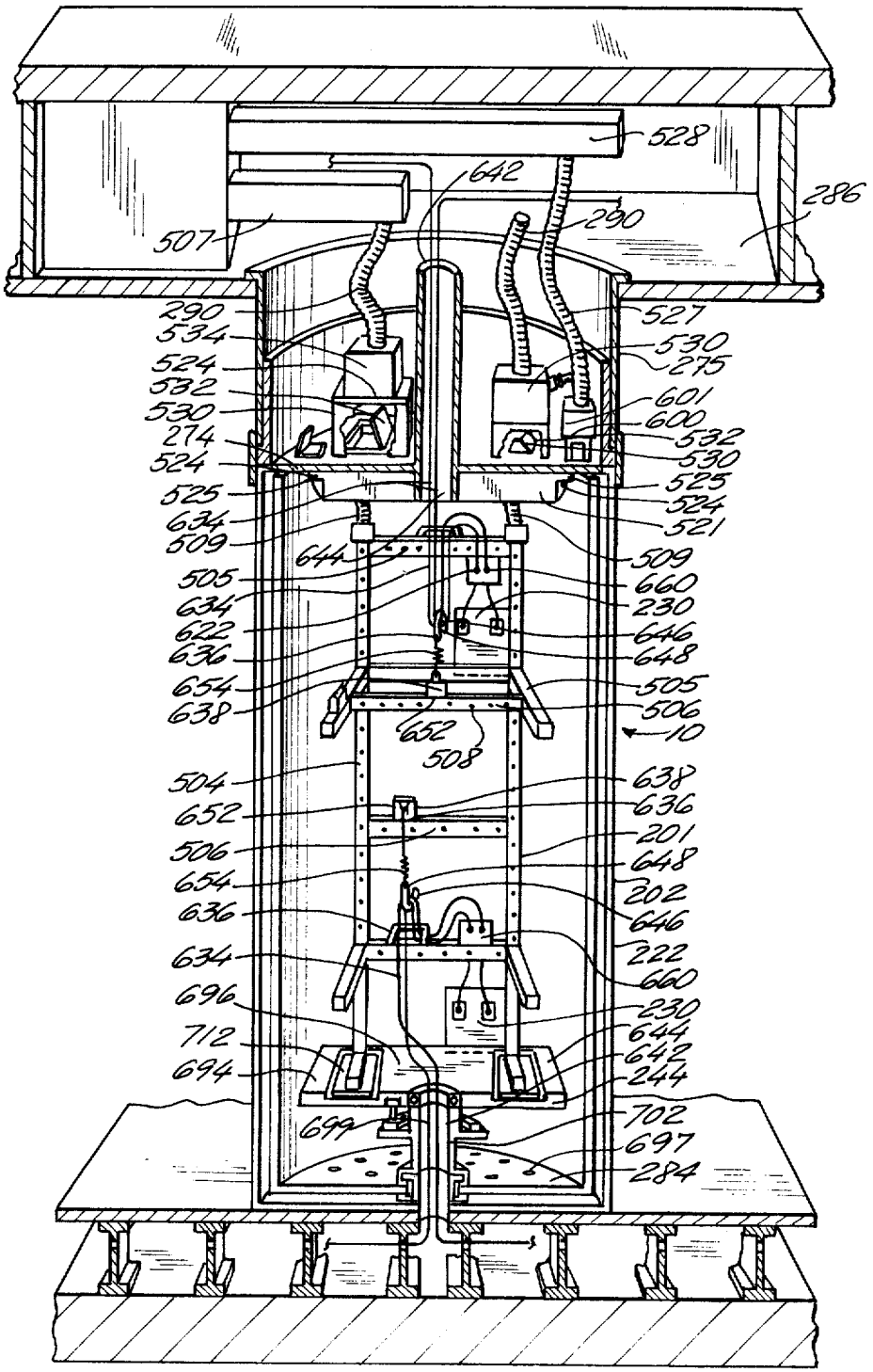
FIG. 3 is a perspective view in vertical section taken along the lines 3—3 of FIG. 1 showing a modification of the enclosure and rack assembly of FIG. 1 integrated into an illustrative building structure; and with elements depicted schematically.

Referring now in more detail to the drawing there is shown with particular reference to FIGS. 1 to 3 a unitary rack assembly enclosure 10 in which the invention is illustratively embodied, that comprises a transaction processing enclosure 200 and rack assembly 201; the latter also shown illustratively in isolation of FIGS. 3 and 5 to 7. The enclosure 200, also described in detail in U.S. Pat. No. 4,121,523 and in copending application Ser. No. 952,782 filed Oct. 19, 1978 by the applicant herein, and the entire disclosure of which is incorporated by reference herein, includes a housing 202, generally cylindrical in conformation, although a variety of shapes or combinations of shapes may be employed, composed of a stationary vertical wall 222 and one or more access means 223.

In one embodiment, the enclosure 200 includes turntable means, plate of platform 244 disposed in independently rotatable relationship with the housing 220 and disposed contiguously therewith in a preferred embodiment. As will be evident in this context, the turntable 244 is essentially flat usually and may have other supplemental turntables (not shown) independently superimposed within the housing 220 each bearing, optionally and additional, rack units 201. The turntables are of any desired horizontal conformation, for example, polygonal, round or the like.

A rack assembly 201 for accommodating a plurality of environmentally sensitive apparatus in an efficient, environmentally controlling, multi-tiered relationship within the enclosure 200 is mounted upon the turntable 244 of the stationary floor of the enclosure.

The turntable 244 provides easy access to the rear or any other aspect of the electronic data processing apparatus, transaction processing machine and the like present on the rack assembly 201 in the enclosure or module 200 for servicing or the like at the same site through the same access element used for other purposes, such as to one or more of the contained machines or apparatus for operation thereof, accomplishing a significant, economy of function and of space. The rotation of the turntable 244 can be integrated selectively through a standard control means, such as the panel 292 (shown in FIG. 4), with opening of one or all of the segments of the enclosure's closure means described in greater detail hereinafter.

The rack assembly as shown in FIGS. 1 to 4 and in isolation in FIGS. 5 to 9 comprises a plurality of legs or vertical tubular support elements 504 which are, in a preferred embodiment, vertically adjustable. In the illustrative embodiment of the drawings, the tubular legs 504 are four in number, although it will be evident that a fewer or greater number may be utilized, for example, but not by way of limitation, three to six or more. The number of legs will vary with the leg diameter, the weight and volume of equipment to be maintained on the rack assembly 201, the volume of fluid to be transmitted through the legs, the size of the enclosure and the like. The legs 504 are preferably disposed in a vertical manner as in the drawing or may be otherwise arranged, as for example, pyramidally, so that they may form a nexus at their apex.

The legs 504 are complemented by a plurality of interconnecting tubular rings, ribs, legs or stretch bars 505. The tubular construction of the legs 504 and ribs 505 provides a system of interconnecting conduits for transfer of fluids throughout the resulting rack assembly 201, and emission of these fluids into the enclosure 200. The ribs or stretch bars, while shown disposed horizontally in the drawing may also be disposed at a variety of angles between the legs and interconnect as well not only with an adjacent leg but with a diagonally disposed leg or vertical support element 504, by way of further illustration. The leg and rib members may assume a variety of cross-sectional conformations, for example, hexagonal, rectangular, elliptical, circular, square, or the like. As the frame members of a support element the ribs 505 have preferably an angular, as opposed to a rounded, construction. It will be evident, too, that the ribs 505 are preferably disposed horizontally for this purpose as well.

Accessory conduits, (not shown) may be employed for the transmission of fluid in combination with the legs serving a supportive function, but this embodiment is normally significantly less preferred because of the redundancy of elements involved.

The assembly of legs 504 and rib 505 thus forms a rigid assembly. Alternatively, or complementing the free standing capacity of the rack assembly means, such as struts, for securing the assemby at various intervals in the interior wall of the housing 200 may also be incorporated. This particular embodiment is not convenient or even desirable normally for it prevents inter alia rotary movement of the assembly 201 within the enclosure 200. Therefore, the presence of a free-standing assembly mounted on the rotatable base or platform is significantly preferred.

The selective distribution of a controlled atmosphere free of contaminents, of a desired temperature and humidity at different points and at different flow rates within the enclosure 200 enables the unit 10 to accommodate within its close confines, a variety of devices, such as electronic data processing apparatus, generating varying amounts of heat, yet sensitive to excess heat (or cold), dampness, pollutants and the like, while utilizing all of the available vertical, as well as horizontal, space within the housing.

In the embodiment of FIGS. 1 to 3 the transaction processing enclosure with its access means, housing 220 and provision for penetration by selected ducts to supply the distribution network of the rack assembly 201 includes closure means 224 (and 225, where an additional inner second closure means is desired and present), the lateral margins of which, in each instance, in the closed position, and thus occluding the access means, are in registry with the wall 222.

In the completely open position the closure means 224 and 225 are preferably disposed respectively within and outside the wall 222, in the open state the closure means 224 and 225 moving in a path defining an axis substantially identical to that of the arcuate wall 222. The stationary wall 222 and secondary closure means elements 224 and 225, define arcs of up to 180° and in one preferred embodiment, define semicircular arcs each of about or precisely 180°, and, as is evident, provide the enclosure or module 200 in the closed state.

The enclosure 200 composed of its foregoing movable and stationary components 222, and 224 and 225, respectively may be formed of a variety of materials. Where a computer assembly reqiring visual monitoring is to be contained in the enclosure 200 one secondary closure means 224 is desirably employed and is formed of a transparent, impact- and normally, a projectile and, bullet-resistant material, and preferably in combination with one or more concentrically mounted secondary closure means 225, formed of a metallic material both fire and impact-resistant. Particularly preferred, however, for use particularly in the elements 222 and 225, however, are the refractor walls and enclosures of copending application Ser. No. 912,974 filed June 5, 1978 and application Ser. No. 102,552 filed Dec. 12, 1979; in both of which applications the inventor herein is one of the applicants.

For convenience of reference where two concentric closure means are used, the outer one, is identified by the designation 224 and the inner one by the reference numeral 225. Where they are segmented horizontally, as described in greater detail hereinafter they are referred to by their upper or lower disposition as **224*a*, the upper outer secondary closure means; 224*b*, the lower outer secondary closure means; 225*c*, the inner upper secondary closure means; and 225*d***, the inner lower secondary closure means.

The closure means may be segmented vertically as well. In addition, a single closure means, for example, 225 may incorporate a secondary access means preferentially protected by a tertiary closure means (not shown) conforming in size and shape with the secondary access means in lieu of dividing the entire closure means 225 horizontally. This embodiment is particularly preferred when the enclosure 200 is used to house automatic banking or transaction equipment, to provide selective customer access to the customer terminal section of this equipment. In addition such a small access means may be incorporated within the stationary wall, 222 of the enclosure 200, also preferentially protected by a tertiary closure means.

Illustratively, as shown in FIGS. 1 to 4, and outer closure means 224, formed of a transparent impact- (e.g. bullet- or projectile-) resistant material is mounted conveniently on a track **226*a* formed on the perimeter of the upper module partition 274 and, additionally or alternatively, (shown as 226*b*) in the perimeter of the module base 284 to enclose or provide access to the housed equipment 230. An inner closure means 225 is disposed within the outer closure means 224 and formed of said steel or other appropriate protective material, preferably the refractory laminate of copending application Ser. No. 102,552, and is mounted in either or preferably both upper and lower tracks 227*a* and 227*b* respectively. In the closed state these closure means are in registry at their lateral borders with the stationary wall 222 by means of closure plates 202 (see FIG. 2). The closure means 225 when opaque, as is normally the case, may also be segmented horizontally and the upper component thereof 225*c* moved to the open state to expose or at least render visible through the outer secondary closure means, 224 and 224*a***, the equipment face and its operation.

Where employed to house an automatic banking machine, the vault portion 231 thereof will ordinarily be disposed within or outside the rack 201 and under the transaction face 232 of the automatic banking machine 230. In this event, as shown in enclosure 200*d* of FIG. 4, for example, and discussed hereinabove, the inner secondary closure means 224 and 225 respectively, which may otherwise be single units, are horizontally segmented to provide two separately rotatable components, an outer upper component 224*a* (shown in FIG. 4) and an outer lower component 224*b* and an inner upper component 225*c* and inner lower component 225*d* of approximately equivalent vertical as well as identical lateral dimensions. The upper secondary closure means 224*a* and 225*c* may be permitted to remain open during banking hours, for example, and closed at other times, or adapted to open when the first or other booth closure means 22*a* passes from the first to the second position.

Alternatively, where access is desired for servicing of the machine or vault positioned under the automatic teller or banking machine face 232, shown schematically, the lower closure means 224*b* and 225*b* are rotated alone or in conjunction with the upper closure means 224*a* and 225*c*.

Figure 4:
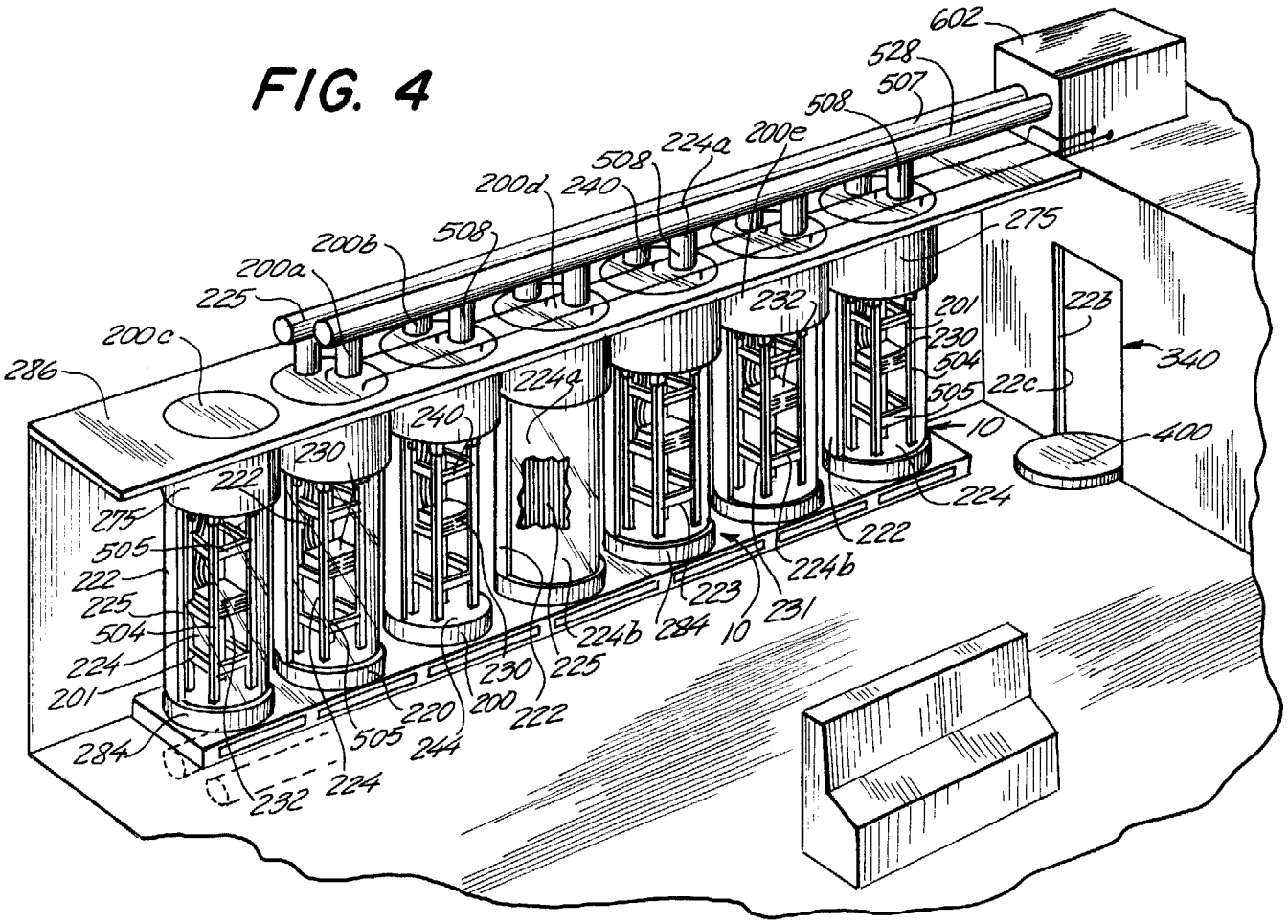
FIG. 4 is a partially broken perspective view of a plurality of the enclosures incorporating the rack assembly components of the invention showing the integration of the enclosures into a building environmental control system, wherein certain of the elements are shown semi-diagrammatically.

The internally disposed secondary closure means 225 and the sum of any horizontally segmented subdivision thereof 225*c* and 225*d*, such as seen in FIG. 4, will normally terminate below the periphery of the platform 284 as shown in FIG. 1 at its lower margin and in the margin of the rotation plate 280 with which it is in fixed engagement at its upper end. Where a banking machine such as an automatic paying or receiving machine is enclosed within the module the inner secondary closure means or access element 225 will extend preferably from the upper module partition 274 by means of a flange (not shown) to the base 284 to comply with the requirements of the Federal Reserve Board as expressed, for example, in Regulation P.

The rack assembly enclosure or transaction processing enclosure 10 may be encapsulated for many purposes, in an exterior protective booth and employ specialized, and specially integrated, entry means in the manner described in the present inventor's U.S. Pat. No. 4,121,523, incorporated by reference herein.

The single access means for operation or repair of one or more of the pieces of equipment lodged in the rack 201 is, in any event, made possible by use of one or more turntables 244 providing easy access to the rear or any other aspect of the transaction processing machine or electronic data processing apparatus present in the module for servicing or the like at the same site through the same access element used for all purposes; accomplishing an economy of function and utilization of space unknown heretofore; particularly in combination with the tiered construction provided by the rack 201. Rotation is, in one embodiment of the turntable, integrated selectively through a standard control panel (not shown) with opening of one or all segments of the various closure means provided.

All of the functions thus far described as well as securing and latching and unlatching of the rack assembly enclosure or module are accomplished manually or conveniently by means of conventional electrical circuitry well-known to one skilled in the art. The control means is similar to that described in U.S. Pat. No. 4,121,523, incorporated by reference herein.

A turntable and the means for rotation thereof applicable for use in the free-standing module of FIGS. 1 to 4 hereof, particularly, is shown and described in U.S. Pat. No. 4,121,523 with particular reference to FIG. 13 thereof and is incorporated by reference herein. Alternatively, the rotation of the turntable may be accomplished by a variety of mechanical means known to those skilled in the art or, indeed, manually.

A drive mechanism for rotation of the closure means 225 may be mounted atop the upper module partition 274 and disposed within the supra module housing 275 as shown in FIGS. 1 and 3, in the manner described in U.S. Pat. No. 4,121,523 again with particular reference to FIG. 13 thereof, and incorporated by reference herein. Standard drive mechanisms may be integrated into a variety of drive trains and positions in relation to the closure means 225.

The inner protective secondary closure means 225 of the module 200 is preferably in continuous contact or registry with the periphery of the rotatable upper module plate 280, as noted hereinabove with reference to U.S. Pat. No. 4,121,523, and may be operated manually as well as mechanically. When inner secondary closure means 225 are divided horizontally into 225*c* and 225*d*, respectively, the support and drive mechanism for 225*c* shall be identical to that described hereinabove for 225 as a single unit. The support and drive mechanism for closure means 225*d* shall consist of an arcuate track on the base 284, of generally circular shape with internal drive ring (not shown) and, a drive motor (not shown). Alternatively, a variety of other methods can be employed as is obvious to one skilled in the art. Of course, manual operation in conjunction with an electrical control means or as an override method of operation of said secondary closure means in event of failure of said drive mechanism is also an alternative, but is less preferred. While described with respect to the inner secondary closure means 225, it will be evident that the outer closure means 224 can be similarly segmented and the modes of operation enunciated hereinabove with respect to the inner secondary closure means 225 applied to the outer secondary closure means 224 will be made registrable with the stationary wall 222 in the open state and its lower edges with the base 284 in a preferred embodiment as also described hereinabove. The upper margins may also be in registry with the supra module partition 274 through an extended closure flange, as also earlier described hereinabove, with respect to the turntable 244. The stationary wall 222 is, in turn, secured within the outer margin of the upper module plate 274 partition 274 and the closure means 225 and extends to the floor or base 284 upon which the unit or module is located. As noted, the upper end of the rotatable protective secondary closure means 225 is, in a preferred embodiment, in contiguous, slidable and sealed relationship by means of a flange (not shown) with the upper module partition 274 and it is where the module and rack encapsulate and support a banking machine, particularly, that the lower end of the closure means 225 is in like engagement with the base 284 of the module as also described above. The secondary closure means 224 and 225 may also be segmented vertically, but this alternative is normally significantly less preferred.

Rotation guide means composed of struts 285 serve to support the turntable or platform 244. These guides may be telescoped and thus extensible to support the platform or turntable 244 at any desired level above the module base 284 and, of course, under the partition 274.

At the same time, a flange may serve to level, in a similar manner, the rotation plate of the inner secondary closure means 225, when present.

In accordance further with the practice of the invention, the system thus described may also be responsive to an alarm and over-ride control in the manner generally of that described with respect to the booths of FIGS. 1 and 4 of U.S. Pat. No. 4,121,523 so that in response to seismic shock from a physical attack of unauthorized or unprogrammed attempt to gain access thereto, experienced by, for example, the banking machine as the result of attempted burglary or other tampering, the inner secondary closure means 225 or its components 225(*c*) or 225(*d*) will close while the closure means 22 will be retained in place securing the miscreant within the booth 10 in one preferred embodiment.

With continued reference to the enclosure or transaction processing module or enclosure 200, and more particularly, to the free-standing manifestation or embodiment of FIGS. 1 to 4 it will be seen that the upper or supra module housing 275 is continuous with or defines entry into a hung ceiling 286, which contains, as shown diagrammatically in FIGS. 1, 3 and 4, the conventional heat, ventilation and air conditioning system as well as electrical and communication lines into which the module may be grafted to provide, where electronic data processing units are encapsulated by the module, for example, the controlled environment necessary to its operation. A riser duct 290 as shown illustratively in FIG. 3, may effect transmission of the foregoing environmental components to the interior of the module 200 and more immediately the rack assembly 201 in the manner described hereinafter. Means of fire detection 294, fire suppression 295, and motor or system control unit 297 and a source of emergency power 299 for these systems are placed in the supra modular housing as shown diagrammatically in FIG. 1 without affecting materially the ease of assembly, disassembly or mobility of the module 200. Alternatively, these elements may be located on the base 284 of the module 200 or under the floor 18 of the unit 10 and respectively, below the turntable of said module 200 or under a raised or flooring system in said booth 10.

With particular reference to FIG. 4 there are shown a plurality of free-standing transaction processing rack assembly enclosure units 10 integrating for purposes of illustration with a hung ceiling above, or alternatively, one below or a combination thereof. The transaction processing units 10 include the supra module housing 275, a stationary wall or housing 222, an access element and the secondary closure means or shield 224 of a transparent character so that the operator of the computer apparatus 230 incorporated in the rack assemblies 201 of the modules 200, may observe their performance without opening the secondary closure means 225 in each instance while stationed at the console or panel 292. However, a second inner (or outer) reinforcing protective secondary closure means 225, as noted hereinabove, composed, illustratively, of fire resistant and impact resistant material, such as steel, or preferably the refractory materials described elsewhere herein may be used to guard the access opening, and maintain the requisite internal environment of the enclosure 10, remaining open and retracted within the housing as shown, illustratively, in the module 200(*c*) of FIG. 4 normally for brief periods of observation where minimal use of the rack assembly environmental control system is desired. The normally light transparent outer concentrically disposed secondary closure means 224, as noted elsewhere herein, serves to protect the environment primarily within the module 200 while permitting observation of the housed equipment during use. The opaque secondary closure means 225 is thus desirably closed when the data processing equipment is or is not in operation or may be manually or automatically closed in the event of fire, flood, or attempted vandalism or inappropriate use of the housed equipment.

Thus, as illustrated further by module 200(*a*) of FIG. 4 the transparent secondary closure means 224 is closed to maintain a controlled environment in the module. In module 200(*b*) of FIG. 4 the outer transparent closure means 224 as well as the internal protective closure means 225, are shown in the open state with the rear of the data processing equipment 230 exposed, having been rotated on the turntable 244 for servicing. Module 200(*c*) of this same drawing is identical in the operative state it presents to that of the module 200(*a*). Module 200(*d*) is shown with both the outer secondary and inner closure means and their segmented components, 224*a*, 224*b*, 225*c*, and 225*d* in the closed state. The rack assembly enclosure 200*c* shows the bank component and transaction component 232 shown diagrammatically, disposed in a rack assembly 201, in the manner described elsewhere herein.

A particular advantage of the present invention is apparent from the embodiment of FIG. 4 in that, as shown, the entire environment of the room in which the transaction processing centers are disposed need not be subject to the rigorous controlled conditions required within the transaction processing centers where electronic data processing equipment is housed. Ingress and egress from the computer containing room can take place freely and yet each module is also protected against vandalism, each secondary closure means 224 being subject to latching in the manner of the booth 10 as described elsewhere herein. At the same time, any unit 10 and any desired piece of electronic data processing equipment can be readily removed from one location and installed immediately, and normally, in a second location by "plugging" of the unit 10 into existing heat, ventilation and air-conditioning lines in the second location.

An extensible ramp may be employed for installation and removal of any data or transaction processing equipment from a module or booth where the support system or turntable upon which the equipment is placed is above the level of the floor.

The legs 504, and ribs 505, vertically and horizontally disposed in the rack assembly 201, as shown in FIGS. 1, 3, 4, 5, 6, 7 and 8 of the drawing are hollow, thereby forming the conduits that are jointed or interconnected as shown, illustratively in FIGS. 1, 3, 4, 5, 6, 7, 8 and 9 to permit the fluid flow, illustratively, of temperature and humidity controlled air or other atmosphere for circulation in the rack assembly 201 for distribution at a predetermined rate and volume through patterns of vents, distribution ducts or openings 506 formed in the legs and ribs of the rack assembly and by this means into the enclosure 200 and to the specific processing components illustrated by the schematically represented unit 230 mounted upon and within the rack 201.

The gaseous fluid distribution system of the rack assembly 201 is connected in a convenient and conventional illustrative embodiment to the riser or supply connector duct or ducts 290 of FIG. 3 in the supra module housing 275 of the enclosure 200; which ducts 290 are in turn connected to a supply duct 507 in the hung ceiling 286 or to an exposed supply duct 507 by passing through an intermediate housing 508 disposed between the supra module housing 275 and the duct 290 as shown in FIG. 4, as a source of temperature and humidity controlled air. The rack assembly is connected to the ducts 290 by means of the rack assembly supply conduit 509. A plurality of these supply conduits may pass between the rack assembly and one or more supply sources. The supply conduit or conduits may be integrated with the rack assembly 201 at one or more positions. In general, it is of particular utility to connect two such conduits 509 to the upper or terminal ends of diagonally disposed vertically arrayed legs 504 of the rack 201. The rack assembly conduits 509 are preferably flexible and extensible, a hose, for example, containing sufficient slack length to permit rotary motion of the rack upon the rack assembly mounting means or turntable 244. The connection of the conduits 509 to a manifold 521 which connects to the risers 290 at one end and to the rack 201 at the other may be detachable for more significant rotation of the rack or removal and disassembly if desired; the connection whether fixed or detachable being affected by means well-known to those skilled in the art.

As shown in FIG. 3 the riser duct 290 is centrally positioned in the supra module housing 275 and the rack assembly conduits 509 communicate with the supply ducts 290 by means of the foregoing intervening manifold, plenum or mixing box 521 mounted on the supra modular partition 274 immediately under the riser or supply ducts 290. The manifold may be fixedly or removably attached to the partition 274 as, for example, by lateral flanges 524 mounted in tracks or bearing surfaces 525 mounted on the under surface of the upper module or enclosure partition 274 for ready removal or repair or replacement. The riser ducts 290 terminate at the partition 274 and are normally coextensive with the lateral borders or the manifold 521. The manifold 521, as indeed the riser duct 290, may assume a variety of constructions.

To effect the transmission of gases through the riser supply duct 290 or to the manifold 521, a communicating orifice or series of orifices (not shown) is provided in the upper or supra module partition 274. This latter partition is perforated as well (although not shown in the drawing) about the exterior periphery of the manifold 521 to provide passage for warm exiting gases leaving the interior of the enclosure 200 and passing into the recovery conduit 527 and from thence into the building return duct 528. The riser duct and return conduit 527 may, even if a plurality of each is present, be enclosed in the intermediate housing 508 in the embodiment of FIG. 4. The turntable 244 or support platform is perforated as well, to assure passage for the rising heated gases formed in contact with the heat producint apparatus maintained on the rack assembly 201.

The turntable 244 or support platform may be perforated, particularly, to prevent pockets of cold air, for example, from accumulating in the bottom of the unit 200, so that monitoring and maintenance of a uniform atmosphere within the enclosure 200 would be more difficult.

Orifices are further provided about the rotation plate 280 when present as shown in U.S. Pat. No. 4,121,523 of a diameter and number sufficient to accommodate the rack assembly supply conduits 509 in their passage from the legs 504 (or the ribs 505 or indeed a combination thereof) to the manifold or mixing box 521. To accommodate for rotation of the rotation plate 280 the supply conduits 509 are made of a flexible material, and have a length sufficient to provide slack, or are otherwise extensible, such as where they are made of a resilient or stretchable material or of an accordian construction.

It is also within the contemplation of this invention that a duct system identical or similar to that provided through the supra modular housing 275 may transmit in like manner from supply ducts, illustratively, a heat, ventilation and air-conditioning system in the floor below that on which the module or enclosure 200 and rack assembly 201 is located as illustrated semi-diagrammatically in FIG. 4 through the module base 284. It is also consistent with the foregoing description, as noted elsewhere herein, that individual heat, ventilation, and atmosphere control systems such as air-conditioning units, for example, suitable for securing the necessary atmospheric control be placed within the supra module housing 275 for delivery to the module interior or chamber optionally by means of the supply ducts 290 or directly through orifices in the supra modular partition, manifold 521, rack assembly supply conduits 509, rack assembly 201 wherein the apparatus 230, and most advantageously, electronic data processing apparatus is located.

Where a dedicated atmospheric unit 599, for a single enclosure 10 such as shown in FIG. 1 or a unit 602, for control of the atmosphere in several enclosures 10, as shown in FIG. 4, is employed, they may also be used in combination with existing building heating, ventilating and air-conditioning systems. In one embodiment, the dedicated atmospheric control unit functions as a heat pump or exchanger, cooling the data processing components housed upon the rack, 201 with air or other fluid atmosphere contained within the enclosure 10 and in some embodiments, within said rack 201. The heat generated by the contained equipment 230 is then released by the atmospheric control unit, 599 or 602 to the exterior of the enclosure or into the return air system of the facility using a return riser duct connector.

In an alternative embodiment, primary environmental control may be accomplished by connection to the central facility heating, ventilating and air conditioning system of the building in which the enclosures are housed and the dedicated atmospheric control unit, 599 or 602, may be used in the event that the remotely treated or central facility is in an inoperative state. In addition, the use of multiple dedicated atmospheric control units provide redundancy or back-up capability in the event of failure of one unit when critical or important electronic equipment is housed within the enclosure, 200.

The perforation of the turntable 244 is also appropriate if the supply duct 507 and return ducts are disposed beneath the base 284 of the enclosure unit 200, and the duct system shown in the supra module housing and communicating therefrom to the rack 201 were transposed to the bottom of the enclosure 200.

In a further and often preferred embodiment, as shown in FIG. 3, the manifold 521 is connected to a plurality, and specifically, a pair of rack assembly supply conduits 509 that pass to a plurality of supply riser ducts 290 (as shown in FIG. 3). The riser ducts 290 may be of a rigid construction but the hose connections or alternative riser ducts or supply connection ducts 290 are also and more frequently made of a flexible material. The supply riser ducts 290 may, for example, be of accordian construction, as well, to integrate with supply ducts disposed at varying heights and whether within a hung ceiling 286 or not.

While the supply riser ducts 290 are often conveniently connected to supply ducts as aforesaid which are, in turn, connected to a source of temperature and humidity controlled air or atmosphere such as a building air conditioning system, the manifold or mixing box 521 may be connected directly to temperature, ventilation and humidity sources mounted with the supra modular housing 275 itself as noted hereinabove and shown in FIG. 1. It will be evident too that fluid-in take or supply means of like character may be incorporated at the base of the enclosure 200, and conveniently between the enclosure floor or base 284 and the turntable 244 or alternative platforms or raised floor similar to the supra module partition 274; together with, if desired and, as noted above, fire detection means 294, fire suppression means 295, a motor or system control unit 297 and a source of emergency power 299 and the like. In addition, the sides or walls of the enclosure may be employed to mount these systems.

At the nexus of the risers or supply ducts 290 and manifold 521 there is interposed in a preferred embodiment one or more fire damper assembly units 530, containing desirably, air filters 535, and a varied speed blower (not shown), the latter employed to augment the flow on controlled atmosphere of like fluid into the mixing box assembly or manifold 521 and thence into the rack assembly 201 and enclosure 200 in the manner described herein. The fire damper assembly includes, as well, means to automatically interrupt and disconnect the gaseous fluid flow, e.g. air or atmosphere, that would otherwise pass into the manifold 521 and the one or more rack assembly supply ducts 509 or from the manifold to the return system.

The fire damper assembly 530, as shown in FIGS. 1 and 3, further includes, accordingly, a fire damper closure means 532 and actuating mechanism 534 (shown diagrammatically) adapted to react automatically to adverse environmental conditions and to seal off that portion of the enclosure 200 containing the rack assembly 201 and associated data processing equipment from intake of further gaseous fluid from the fluid supply means, such as the supply ducts entering the riser duct 290. Pollutants including combustion products, flame elevated temperatures and the like are thus prevented from passing through the manifold 521 into the rack assembly supply conduits 509, and thus into the rack assembly 201 and enclosure 200 by virtue of the fire damper closure means 532.

The fire damper assembly 530 is of special utility when air is drawn from the heating, ventilating and air conditioning system of a surrounding facility so that, in the event of fire, or even flood or similar occurrence where heat or noxious elements such as smoke particles or water may be present, these elements may be prevented from entering the manifold assembly or mixing box 521 by the prompt closure of the fire damper assembly 530. The operation of the fire damper assembly 530 is preferably actuated by a motor or system control center of the data processing equipment enclosure responding to environmental conditions monitored by the fire detection and security systems, shown diagrammatically, of data processing equipment enclosure. In order to completely seal the enclosure in the event of fire or the development of other hostile conditions, both the supply and exhaust environmental system should be sealed by the fire damper system. In FIG. 1, a sliding configuration of the damper, 532 with activation means 534 is shown. In FIG. 3 a hinged, flap closure arrangement is shown illustratively.

The fire dampers may be actuated, for example, by electrical pneumatic, mechanical or manual means. The exhaust fire damper system 600 is shown in FIG. 3 and described hereinbelow.

As indicated, the vertically disposed legs 504 and ribs 505, the latter the horizontal supporting members, of FIGS. 1, 3, 5, 6, 7 and 8 particularly, are hollow thereby forming the conduits that are joined as shown in FIG. 6 to permit the fluid flow of temperature and humidity controlled air or other atmosphere or fluid from the manifold 521 into the rack assembly 201 for circulation selectively to the data processing components, illustrated by the diagrammatically defined unit 230, mounted within the rack 201 in FIG. 1, to dissipate the heat generated by the equipment. To permit the distribution of fluid within the housing 220 and to the components 230, the legs 505 and preferably, albeit optionally, the horizontal supporting members are provided with air distribution vents, ducts or openings, 506, at intervals as shown along the legs or ribs in FIG. 3, where the surfaces of said ducts are in proximity to any contained data processing component 230.

The vent openings 506 are normally disposed as a plurality of longitudinally aligned apertures or flow damper regulatory apertures 506 positioned in varying positions along the tubular leg or rib members. It will be evident that the number and size of these apertures may be varied to accommodate, for example, a standardized distribution of components within the rack assembly 201, as for example, where the components of a computer system or other electronic equipment or the like is distributed thereon, preferably with removal of its outer surface or "skin". The assembly 201 of the invention, to have a multi-faceted utility, however, employs means for varying fluid egress or flow from the leg and rib members, in addition, or as an alternative, to varying the permanent location, dimensions and concentration of the vents or apertures. This additional means which can also be varied to accommodate the need of a particular component depending on its heat production or other environmental control requirements at different times, comprises, in one embodiment shown illustratively in FIG. 7, one or a plurality of fluid flow dampers 560 formed of a longitudinal shaft or plate member that abuts the aperture-containing portion of the interior wall or walls of the leg and rib members. The damper plate 560 contains a plurality of apertures 562 corresponding to those of the leg, for example, upon which the plate is mounted. The plate 560 is mounted to avoid transverse movement or "play" normally but to facilitate movement slidably in a longitudinal manner along the leg member and is adapted to facilitate fastening at a plurality of points so that the apertures of leg and plate can correspond completely or result in partially or completely occluded vents. The flow damper may also be polygonal so as to operate with respect to two, three, four or, if present, more sides of the leg or rib in which it is lodged. A guide may be provided for this purpose. The plate may also be imperforate along a substantial portion of its length so that only a number of perforations of the leg and plate actually integrate and a portion or all of the vents in the leg may be sealed by an imperforate portion of the plate by slidable displacement of the plate in the appropriate direction.

To maintain the plate or flow damper and perforate leg in fixed position with respect to each other, a bolt or seal screw 564 or a plurality thereof, normally two for convenience, is inserted through the apertures of leg and plate, which are adapted to receive the set screw 564 in threaded engagement although to secure a varying degree of partial occlusion of cooperating leg and plate apertures, the plate may contain apertures of increased length in the longitudinal direction corresponding to the alignment of the apertures in leg and plate. These elongate plate apertures 568 are intended to receive the set screws which are then threadedly engaged only within the corresponding leg or rib apertures used for producing a fixed relationship of plate and leg; and because of the elongate conformation of the plate aperture the plate may be set in a variety of positions along its length corresponding to phases extending from complete or partial cooperation of the remaining apertures 506 to complete occlusion thereof.

A second damping means employed in the practice of the invention is one having particular utility at the junction of horizontal and vertical support members, 504 and 505, respectively, and referred to as a junction flow damper 570. This damper may be employed to adjust or stop the flow of air from one rib or leg support member to the other, as shown in FIGS. 7 and 8 or from a rack assembly supply conduit 509 into the rack assembly 201. The junction flow damper 570, conforms in general size and shape with the interior cross-section of the conduit in which it is disposed.

The function flow damper 570 may be mounted in the interior of the leg or rib using a small standard hinge or similar element 572, as well as means to control and activate the movement of said junction flow damper, such as the assembly 576 shown in FIGS. 6 and 8 which may be manually, mechanically or electrically operated by standard means well-known to those skilled in the art.

The junction flow damper control 578 comprising the flow damper connection element 580, and the flow damper position adjustment element or rod 582, may be fixedly engaged in an open, closed or partially open position within the tubular conduit of the leg or rib 504 or 505 respectively, from which the rod extends through the assembly leg or rib to the rack exterior as shown in FIG. 8.

In one preferred embodiment, the junction flow damper position adjustment element or rod 582 generally round in cross-section is threadedly engaged within the orifice 584 through which it defines entry into the tubular conduit of the rib as shown in FIG. 8, so that rotation of said flow damper position adjustment element 582, will affect linear movement of said element relative to said opening or orifice 584 and move the damper 570 to an open or closed position. In this embodiment, the position adjustment element 582 may be joined to the junction flow damper connection element 582, using a universal bearing joint or similar device adapted to permit the rotation of the junction flow damper position element 580, while transmitting the linear movement of the element 580 directly to the junction flow damper connection element 580.

To further circulate, or selectively force the circulation of, temperature and humidity-controlled air or atmosphere through the data processing components rack 201, auxiliary means 592 (shown diagrammatically in FIG. 5) of augmenting the flow of atmosphere may be contained within the rack or attached to said leg (504) or rib (505) support members. These auxiliary atmosphere flow means 592 may include, illustratively, a variable speed van or fluid impelling assembly in which the fan motor is capable of operating at varied speeds so that the flow of air or other fluid through the support members may be selectively regulated.

The rate of flow of air or other atmosphere from the leg and rib support members 504 and 505 of the rack 201 may be controlled, additionally, using a variety of means including flow valves or nozzles 590 (as shown in FIG. 7) on all or selected apertures 506.

Recapitulating the practice and process here involved, fluid, a gaseous fluid such as air, is directed from the riser ducts or ducts 290 (**290*a* and 290*b*) whether supplied thereto from a dedicated air conditioning system in the supra module housing 275 or, illustratively, the supply duct 507 of a building system. The fluid is then transmitted through open fire damper closure assembly means 530, through orifices in the supra module partition 274 to the manifold 521 and into the rack assembly supply conduits or connecting rack assembly conduits 509 to the legs 504 and ribs 505 subject to opening of the junction flow dampers 570 arrayed desirably at each interconnection of rib and leg, and normally at the entry from the leg into the rib, so that no junction flow dampers are present along the more or less vertical length of the rack legs, although provision therefor may be made as desired and emission of fluid therefrom through the apertures 506 controlled and modified by the flow dampers or damper plates in or optionally on the exterior of the leg and rib walls. The flow valves or nozzles 590 may also be employed for fluid emission control from the orifices 506**. In addition, the rack may be sealed and provide a continuous closed fluid system.

The fluid gas or air emitted to the interior of the transaction processing enclosure 200 moves about and contacts the apparatus 230 resident in the enclosure which normally generates heat, when in use, at a substantial rate. The emitted fluid provides the ventilation and environmental conditions essential to proper maintenance and performance of electronic apparatus particularly when maintained in a relatively confined space. As the equipment in the enclosure generates heat, and the temperature outside of the rack 201 and within the enclosure 200 is generally above that of the rack, the flow of air once disseminated from the rack into the enclosure is upward.

The circulation and upward flow of the gaseous fluid atmosphere, warmed and rising may be accelerated by a vacuum pump or suction blower 601 disposed, illustratively, in the supra modular housing 275. In any event, the air is withdrawn from the enclosure 201 through the apertures of the upper module or rotation plate 280 where present as described in U.S. Pat. No. 4,121,523, and the upper module partition 274 at a point or points in the latter where gases pass into and through an exhaust fire damper assembly 600 and exhaust conduit 527 and thence out of the enclosure 200, or, alternatively, recycled through the dedicated environmental control unit 599. The exhaust fire damper assembly 600 is operated in a manner similar to those assemblies 524 described with respect to gas or air intake into the rack assembly 201 from the riser ducts 290. The exhaust fire damper is open, normally, and is activated to a closed position ordinarily in the event of fire or other emergency adversely affecting the flow, content and temperature of gases to or from the enclosure 200. The fire damper assemblies, of which that shown diagrammatically and designated 600 is illustrative, may also include variable speed fans to assure the proper flow of air, to accelerate the flow thereof in the exhaust direction and to obviate reverse flow.

As noted, the exhaust flow dampers 600 are connected to a duct system similar to that employed in moving the gaseous fluids into the supra-modular housing 275, that is, a riser duct or return connection duct 527 or a plurality of such ducts and into the return duct 528 of, for example, a return air system in a central building or room air conditioning system, or alternatively, from the return duct or a plenum directly into a small, dedicated air-conditioning and humidity control unit, as discussed elsewhere herein or, indeed, simply into the atmosphere surrounding the enclosure 200.

A plurality of transaction processing rack assembly enclosures 10, such as shown in FIG. 4 may be supplied with a controlled atmosphere by one or more small dedicated heat, ventilation and air-conditioning units 602. Using a plurality of rack assembly supply conduits 509 connected at different points to a rack assembly 201, several air conditioning or other fluid supply units may also supply several portions of one or several legs or ribs of a rack with differing atmospheres to be distributed into a particular segment of the enclosure 200 to aerate different pieces of equipment in the several different areas, segments or compartments of the enclosure 200 and the plurality of data processing components distributed throughout the rack. To effect this tiered or segmented aeration or gaseous fluid flow the junction flow dampers 570 are desirably mounted to effect selective closure at a variety of points along the legs and ribs of the rack.

To the extent that there is no access to the ambient atmosphere surrounding the transaction processing enclosures 10, the atmosphere, where a dedicated air-conditioning and humidifying unit is involved, may simply be recirculated for indefinite periods of time. This system of recycling is preferred for many purposes, since the use of fresh air, that is available from the ambient atmosphere, requires use of additional energy supplies for filtration and adjustment of the temperature and humidity of the incoming ambient atmosphere.

Of advantage in using a dedicated air-conditioning apparatus is that it may be made to respond to the particular needs of an enclosure most efficiently and economically. Thus, an enclosure so equipped will thus respond to, and need only be sufficient to meet, the requirement engendered by the heat of the particular data processing components 230, for example, and other support equipment within the enclosure 200 together with any temporary changes in temperature or humidity introduced by air from the exterior when said data processing equipment enclosure is opened as well as those usually minimal or gradual in temperature caused by heat exchange through the housing member partitions and closure means of the rack enclosure 200. This latter source of heat exchange is significantly reduced or eliminated through use of refractory composite panels, as described in a copending application of which the applicant herein is one of the inventors, entitled "Refractory Composite Panels and Panel Systems", U.S. patent application Ser. No. 912,974, filed June 5, 1978 the disclosure of which is incorporated by reference herein. This latter application discloses a preferred enclosure housing formed of a composite laminate with thermal and humidity barrier properties and the like for use in the enclosures of the invention.

The rack itself is usually constructed of steel, aluminum, alloys thereof other conventional relatively inflexible tubing materials or, indeed, of the foregoing laminate.

To support and maintain the electronic data processing components at various positions within the rack 201 a variety of attachment and support means are employed including, for example, trays, platforms or receptacles.

Figure 9:
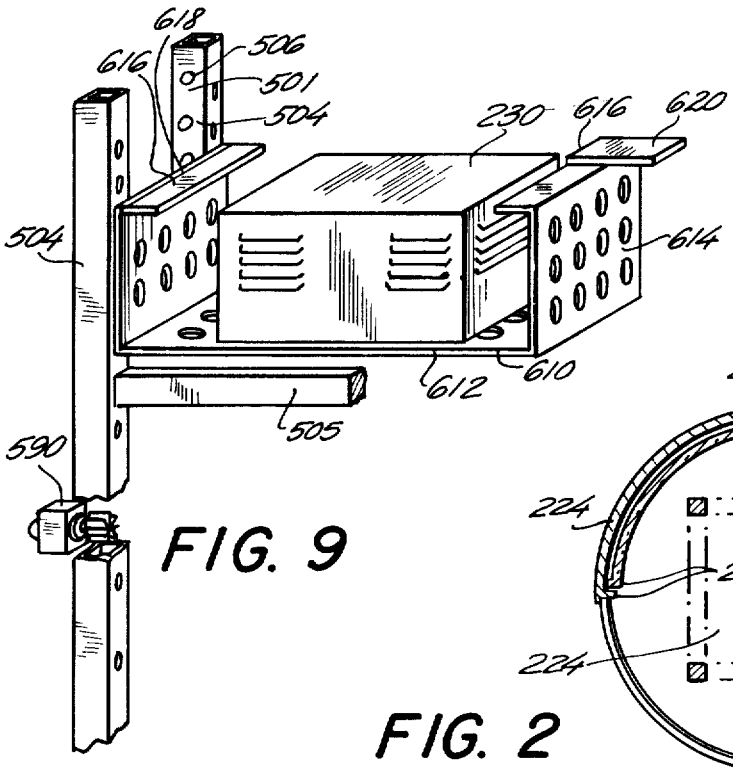
FIG. 9 is a fragmentary perspective view of an illustrative embodiment of the invention wherein a shelf bearing a data processing element depicted semi diagrammatically is mounted upon the rack assembly means.

Means for supporting electronic data processing equipment 230 components or valuable documents and the like may be disposed on the legs 504 as well as on the ribs 505 of the rack 201. An illustrative equipment support unit 610 is shown in FIG. 9 wherein the unit 610 comprises the support base or tray 612, side walls 614 and flanges 616. The unit 610 is mounted at its opposite ends by means of terminal flanges or tongues 616 in horizontally disposed tracks 618 formed on the horizontal ribs 505 to which they may be affixed by clips or stop elements 620 or confined at the opposite ends of each flange 616 by the adjacent vertical legs. The tray may also be mounted on the rack by simply placing the flanges over the horizontal ribs or reach bars 505 of the rack 201, as well as abutting the legs 505 at either end as described hereinabove. The tray 612 may also have upwardly extending protuberances (not shown) on its surface to support a piece of equipment such as data processing component 230 (shown diagrammatically) in spaced relation to the tray surface. The entire tray is perforated in a preferred embodiment, in any event, to allow access to circulating gases emitted from the rack and to better enable the heated atmosphere about the component 503 to be removed from the enclosure 200. The foregoing protuberances facilitate circulation through the perforate tray 612.

Shelves 630 attached to only one margin or rib 505 may also be employed such as shown in FIGS. 5 and 6. These shelves may be conveniently bolted or threadedly engaged also by means of screws through certain of the apertures provided in the ribs 505. The shelves 630 may be telescoped to accommodate a variety of sizes of equipment while providing the minimally required shelf space and thus minimal obstruction to the movement of gases in the enclosure. These shelves 630 are normally perforated as well for this purpose.

It is also within the scope of this invention to include carrousel or turntable means within said rack 201 to conveniently store and catalogue such valuable documents and information as computer disks and tapes, and solid-state memory devices including R.O.M. (read-only-memory) and "bubble" memory storage devices as well as critical files, securities and the like.

Control means may be integrated with said rack to effect the categorizing of the information or documents contained therein and adapted with means to automatically store or retrieve said information or documents.

The cables 634 that occur as a necessary incident to electronic data processing equipment and the like stored for operation within the rack enclosure 10 including those components supplying power to the data processing apparatus in the rack 201 and those adapted to communicate between the components present in the rack are accommodated in accordance with the invention by means of the cable retention and control means 638 illustrated particularly in FIGS. 1, 3, 5 and 6.

The foregoing equipment cables 634 are adapted in a preferred embodiment to pass between the interior of the enclosure 10 where it is connected to the contained equipment components and the booth exterior, for example, to a power source through one or more axially disposed conduits, an upper and lower conduit, 640 and 644 respectively. The upper cable conduit 640 defines a path through the supra module partition 274 and housing 275 emerging into a hung ceiling or other environment exterior to the enclosure 10. The equipment cables 634 contained in the hung ceiling, for example, through which they pass or from a power source 602, or communication center, enter the outer open end 642 of the conduit 640 and emerge at the inner end thereof 644 into the enclosure 200 passing directly to and through the cable retention means or holding ring 636 of the cable retention and control means 638. The retention means 636 is mounted upon a leg 504, or preferably for many purposes a rib 505, and serve to orient the entering cables in a slack clustered engagement from which they pass to the cable binding ring 646 having preferably an adjustable diameter and formed of a smooth, strong material of generally non-eroding character, which may be firm or a resilient, or soft, pliant material such as rubber, or the like. The cable binding ring 646 is secured to a spring or other tension control device 654 and the latter, in one embodiment is attached to a connecting or tension cable cord 648. The cord is desirably metered out of an automated tension control means 652 and a spring 654 to assure the desired tension on the cable 634 in the cable binding ring 646. A spring alone 654, or, indeed, a motor device, may be employed eliminating use of the tension control means 652 and tension cable or cord 648. The tension control means 652 is mounted on a rib 505 and disposed vertically below that to which the cable retention means 638 is secured. The equipment cables 634 are next routed to a yoke assembly 660 mounted conveniently adjacent the holding ring 636 on the same rib 505 or one disposed at the same level, although the particular level is not narrowly critical, so long as it is on the same side of the cable binding ring or hook 646 as the holding ring 636 so that the cables 634 in passing to the yoke assembly will pass through the holding ring 636 and through or over the binding ring or hook 646, back through the holding ring in a direction opposite to that in which the cables passed through the ring 636 in their initial passage from the conduit 640 and thence to the yoke 660.

It will be evident that a second holding ring 636 may be used to contain the cables in their return from the binding ring or hook 646 enroute to the yoke assembly 660, and thence through which the cables pass to the individual equipment components 230. The clustered cables are separated and held in fixed engagement by the yoke 660.

The controlled metering and orderly distribution of the cables within the rack assembly enclosure 10 is significant in preservation of the cable, prevention of the tangling thereof, and, with its concomitant efficiency, is particularly important in permitting use of a reduced area for distribution and maintenance of a maximum number of data processing or other equipment components within the enclosure 10. This facet of the present invention is particularly significant in order to provide limited, or a single, access means to the enclosure which is accomplished in a preferred embodiment by means of a turntable 244 such as described elsewhere herein.

The metering and distribution of equipment cables as described hereinabove has particular reference to those cables 634 entering the rack enclosure 10 through the upper cable conduit 640.

It will be evident that equipment cables 634 may be fed alternatively or simultaneously from a power source or the like through a building floor underneath the enclosure 10 as shown in FIG. 3 and enter the enclosure through the lower cable conduit 642 passing in like manner to that described hereinabove and sequentially to a retention means or holder 636 binding ring 660 and back through the holder after forming a cable loop and passing thence to the yoke assembly 660 and equipment components 230. The use of cable distribution means and entry thereinto of cable at both ends of the enclosure 10 is useful where a large number of cables 634 and components 230 are introduced into the enclosure 10.

The yoke assemblies 660 are panels containing a plurality of orifices 662 of adjustable diameter. The panel is, in each instance, constructed of firm, resilient material having a high dielectric strength such as rubber or plastics. The diameter of the panel orifices 662 may be fixed and of standard size in which case, however, caulking compound, such as silicone rubber may be secured about the surface of the cable 634 at the orifice 662 to assure fixed engagement of the cable therein.

The use of the automated tension control means 652 is particularly preferred where the rack is mounted on a turntable 244 so that ready adjustment to the variations in tension on the cable 634 and the need for increased lengths of cable 634 (or diminution thereof) may be readily accommodated. For this purpose, senson means (not shown) are conveniently incorporated in the tension control means 652, which may be adjustable.

The foregoing sensor or detector means comprises, desirably, an electrical circuit or mechanical transmission known to those skilled in this art. The control and tension metering of the device 652 is integrated with means to extend and retract the spring 654 and tension cable 648 or other appropriate means known to those skilled in the art to release or take up the slack of the cable loops in response to the rotation of the rack 201, or where so adapted movement of the rack assembly laterally on an extensible ramp of the turntable 244 or the enclosure floor or base 284 through the enclosure access means to the enclosure exterior. It is also feasible to raise and lower the turntable 244 and rack 201 if desired and described elsewhere herein.

Figure 11:
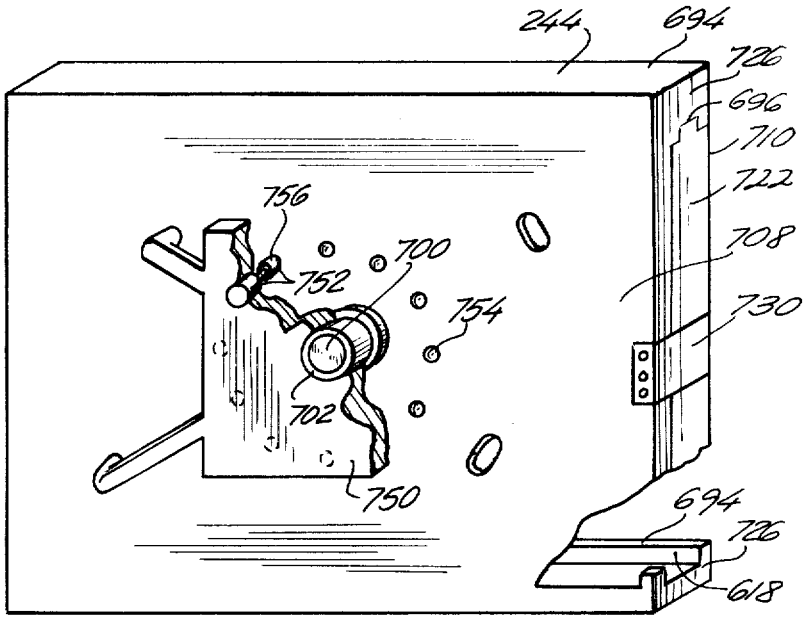
FIG. 11 is a fragmentary perspective view of the cooperating drive shaft and related means disposed beneath the floor of the enclosure for rotating the rack assembly platform.

A rack assembly mount or turntable 244 adjusted to vertical movement and incorporating a slidable extension component 680 upon which the rack 201 is disposed is shown particularly in FIGS. 3, 10 and 11.

Figure 13:
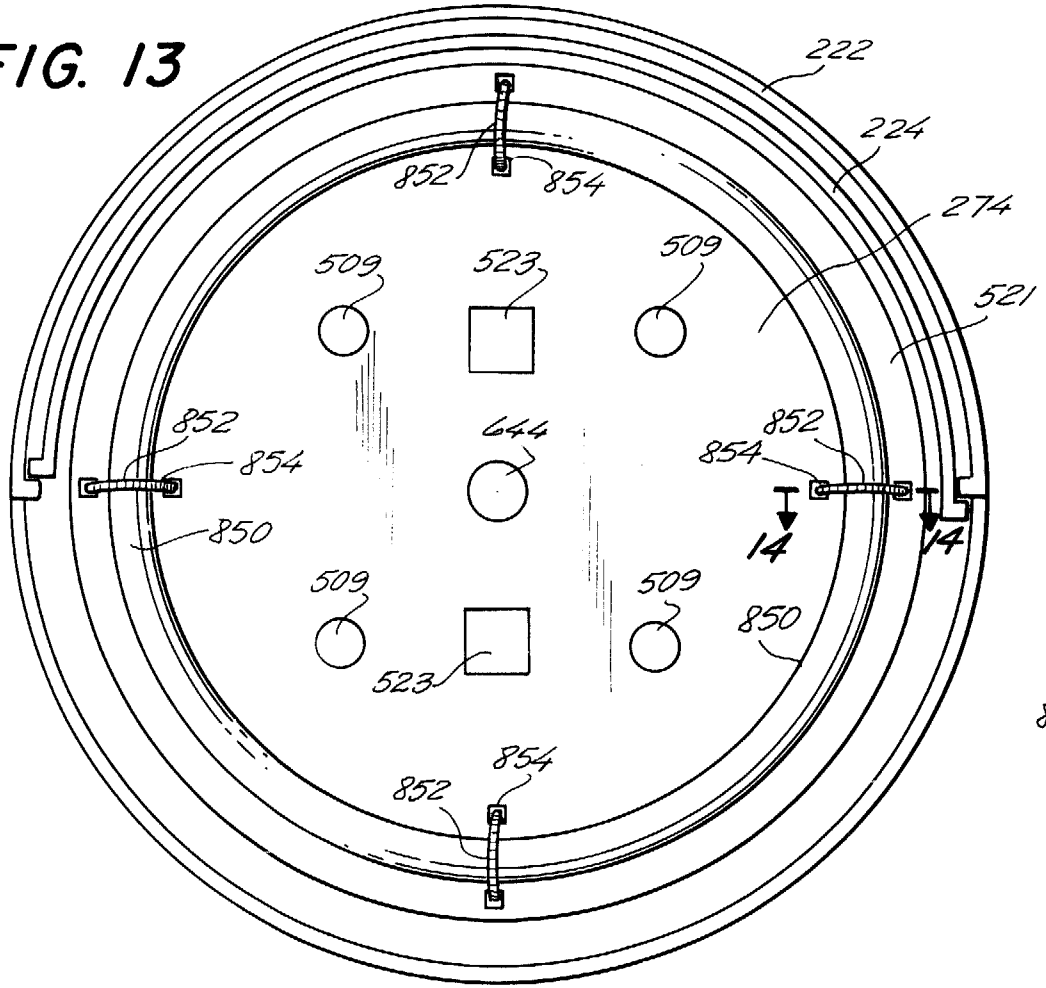
FIG. 13 is a horizontal sectional view taken along the lines 13—13 of FIG. 2.

The enclosure for containment of the rack assembly 201 may also be constructed in the manner shown in FIG. 13 of U.S. Pat. No. 4,121,523 and described therein and incorporated by reference herein in thich the upper module rotation plate 280 of the patent (rendered perforate) is present and the rotatable shaft 276, also of the patent, is made hollow for the purpose of serving as a cable conduit 640 in the manner shown, for example, in FIG. 3 of the drawings herein. Arcuately shaped orifices (not shown) may, in this instance, usually of up to 180°, may be formed in the rotation plate 280 to accommodate rotation of the plate 280 of the patent, without impinging upon the rack assembly supply ducts 509 or the like, as shown in FIG. 3 hereof.

The rack assembly mount or turntable 244 is composed of a stationary platform component 690 and a slidable platform component 692; the two components having a coplanar horizontal alignment. The stationary platform 690 is formed of two lateral wings 694 forming opposite borders of the rack assembly mount 244 and an intermediate tongue 696 extending outwardly from a common base 698 in parallel alignment with the two foregoing wings 694. The common base 698 of the stationary platform 690 forms a third margin of the turntable connecting those provided by the two wings 694. The tongue 696 extends forward sufficiently to encompass the orifice 699 which defines passage for the lower cable conduit 700 and the axle 702 for support and optional rotation of the assembly mount or turntable 244 thus preventing occlusion of the axle or centrally positioned assembly mount support means 702 or shearing of the cables 634 entrained within the cable conduit 644 at their point of entry into the enclosure 10. In one embodiment, as shown in FIG. 11, the base member 698, wings 694 and tongue 696 are interconnected on the bottom surface of the platform 690 to provide a supporting tray 708 for the extensible platform 692. The movable or extensible platform 692 comprises a body 710 and two lateral arms 712 adapted for fitted engagement on and about the tongue 696 and between the offsets or recesses of the wings 694 of the stationary platform. The two arms 712 and the body 710 of the extensible platform 692 are adapted to seat the rack assembly 201, as shown illustratively in FIG. 3, where the ribs 505 and legs 504 are mounted along the length of the arms 712 and the body 710. As shown in FIG. 3 the rack 201 omits an interconnecting leg across the base 698 on the assembly mount or turntable although one may be present so long as it is removed from contact with the surface of the base 698 or tongue 696 so that the rack 201 can move freely on the extensible platform 692 as it is moved laterally away from its fitting abutment with the stationary platform 690.

The lateral or outer margins of the body 710 and arms 712 are adapted for slideable engagement illustratively by provision of a track or channel 718 on the inner abutting margins of the wings 694. The outer margins of the body and arms are provided with continuous shoulders or flanges 720 that fit in the foregoing channels to provide the extensible interaction between the stationary (690) and movable (692) platform components.

The extension of the slidable platform 692 of the rack assembly mount or turntable 244 laterally is controlled by manual, mechanical or electrical means or combinations thereof.

Offsets or recesses 693 are conveniently provided along the channels or tracks of the arms 694 of the inextensible or stationary platform 690 to abut with stop elements or detents 695 provided along the lateral margins of the wings 712 of the laterally movable platform 692 to prevent uncontrolled movement or separation of the segments 690 and 692 of the assembly mount 244 from one another. This arrangement is most effective where the platform segments are formed of a resilient material.

The free outlet margin 722 of the body 710 of the extensible platform 692 may be constructed to register with the terminal borders 726 of the wings 694 of the stationary platform component 690, and support tray 708. The extensible platform may be secured in registry with the support tray 708 and wings 694 by any standard means, such as a hinged spring steel clip 730 as shown in FIG. 11 or by locking the drive engagement means of the extensible platform 692. As described elsewhere herein, the turntable 244 is perforated to provide for free flow of gaseous fluids within the rack assembly enclosure 10. This is accomplished where extensible 692 and inextensible 690 components are present by having the perforation 697 (shown illustratively in FIGS. 1 and 3) of the two platforms in registry when the extensible platform 692 is in enclosed abutting relation to the inextensible platform 690 the normal state except during repair or maintenance of equipment 230 in one embodiment of the invention.

The rack assembly mount or turntable 244 is mounted upon the axle 702 by means of the intermediate tongue 696 of the laterally inextensible or stationary platform 690. The tongue is mounted about the upper terminal periphery of the axle 702 and provides the orifice 699 for the lower conduit 644 contained within and formed by the axle 702 as described elsewhere herein.

The axle 702 which forms part of a platform or turntable support assembly 739 is adapted for rotation by standard mechanical or electrical means, or even manually, or a combination of the foregoing, that will include provision for adjustment of the height of the turntable 244, as well, in a preferred embodiment. The axle 702 may be formed of a plurality of telescoping tubular components for this purpose. The axle and its components are sufficiently strong, in any event, to support the equipment likely to be mounted upon the rack assembly 201 seated on the turntable 244, including, illustratively, one or more electronic equipment components or mainframe computer apparatus with the outer sheath removed, ranging in weight up to five hundred to six hundred pounds and indeed several thousand pounds or more.

In a preferred embodiment, shown semi-diagrammatically in FIG. 10 vertical adjustment of the support axle 702, and the rack assembly 201 and turntable 244, is secured by means of a hydraulic jack assembly 740. This assembly includes a standard hydraulic cylinder 741 mounted about the axle 702. The hydraulic cylinder 741 is connected to a pressure transducer 742 by means of the cable 743. The transducer may include, for example, a hydraulic or gas actuating cylinder and pressure release assembly and may be operated manually by means of the foot pedal 744 as shown illustratively in FIG. 10. Where manual operation of the jack assembly is contemplated, particularly, the actuating means, such as the pedal 744 and associated hydraulic and pressure release system are mounted conveniently on the floor 284 of the enclosure 200 in proximity to the enclosure access means. Electrical, electromechanical or other standard means of operation may be integrated to effect not only vertical adjustment but rotation of the axle 702 and turntable 244 and may be provided exclusively within the enclosure 200 or adapted to operate by a control means disposed outside of and remote from the enclosure 200.

The rotation of the turntable may, when present, be effected by means completely severed from those used for vertical adjustment of the rack assembly 201.

Means for securing the rack assembly 201 and the turntable 244 and axle 702 on which they are disposed in fixed position with respect to rotary movement thereof is also incorporated in the practice of the present invention.

Thus, as shown with particular reference to FIGS. 10 and 11 of the drawings, there is disposed in spaced relation to the under surface of the inextensible platform 690 and about the axle 702, but in a fixed position free of engagement therewith, a rotary control plate 750 incorporating a spring biased bolt 752 mounted in the upper surface of the plate 750 and adapted to be received in the recesses 754 mounted radially about and at a like distance from, the axle 702. This arrangement permits the bolt 752 to be released and received in any predetermined recess 754 in the course of rotation of the plate 750, staying the rotation of the turntable 244 together with the rotary movement of the plate 750 and axle 702. When the bolt 752 is withdrawn from a recess 754 against the force of the spring 756 the turntable 244 will rotate in response to the rotary movement of the axle 702. The bolt 752 is retracted in the embodiment shown in FIG. 10 by manual activation of the foot pedal 758 which communicates with the plate 750 and bolt 752 by means of the cable contained in the structural support member 760 using conventional electrical circuitry although a variety of other mechanical and electromechanical means may be supplied. The plate is maintained in position by a plurality of structural members, two of which 770, 771 appear in FIG. 10. Normally three or four generally evenly spaced legs or members secured to the floor 284 at one end and to the sides of the plate assembly 750 are employed.

To otherwise prevent rotation of the turntable 244 in excess of 180° which is ordinarily unnecessary and tends to induce tangling and undue extension of equipment cables and damage or at least significantly less effective utilization of the supply ducts 507 and return ducts 509 and the like, in any event, the plate 750 is provided with rotary control arms 760 as shown in FIG. 11. These arms 760 radiate from the rotary control plate 750 and terminate in upwardly directed fingers or stops 762 adapted to interrupt downwardly disposed stops or detents 764 projecting at suitable intervals from the bottom of the platform 690. In one embodiment, the control arms 760 are attached to the plate 750 or about the axle in such a manner as to provide for rotation to a variety of fixed positions so that, for example, arcs of less than 180° in rotation of the turntable 244 can be secured as desired.

Figure 12:
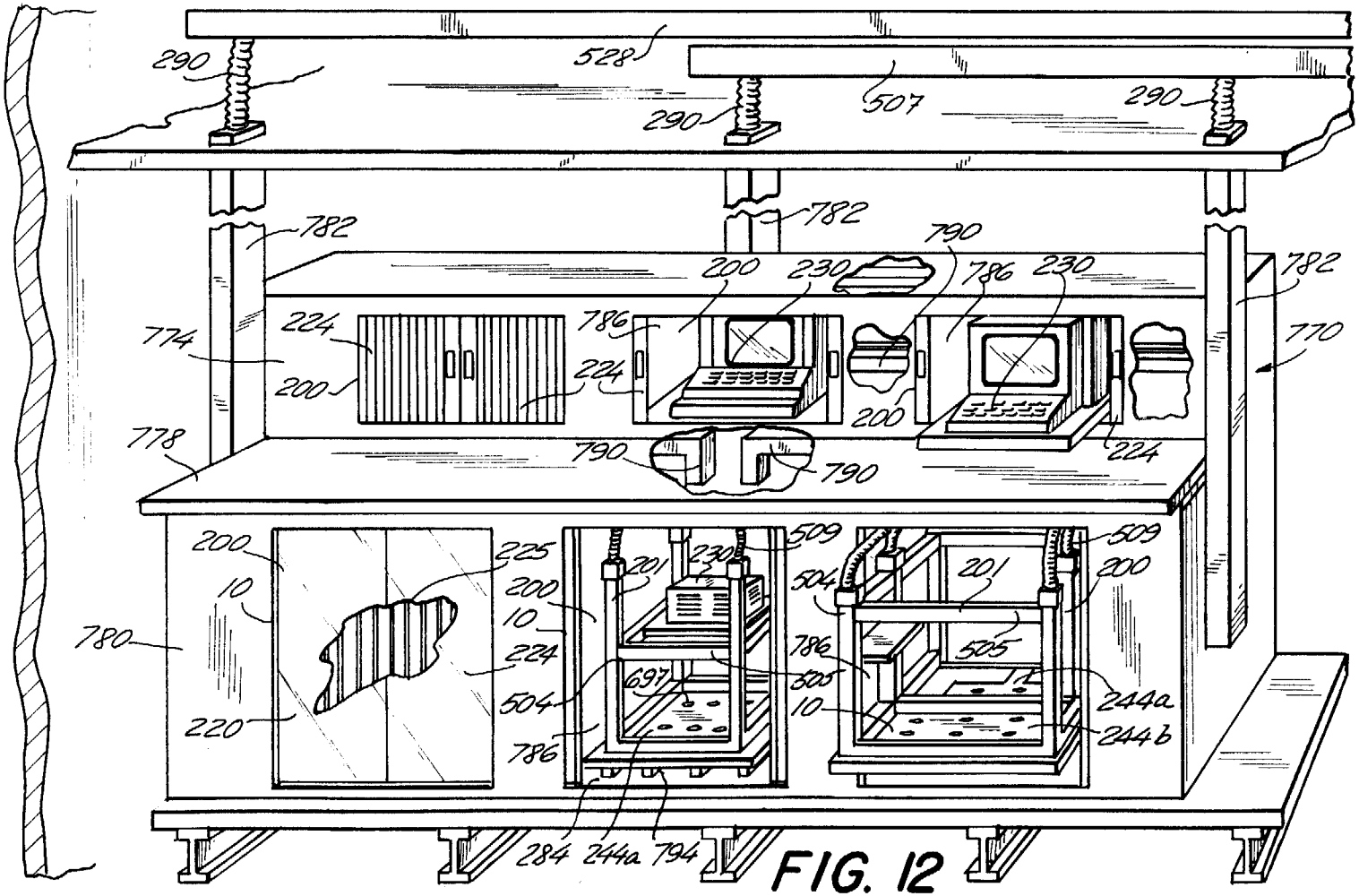
FIG. 12 is a side elevation view of a further illustrative embodiment of apparatus incorporating the practice of the invention.

A further and modified embodiment of the rack assembly enclosure 10 of the invention is shown in FIG. 12. In the assembly of this latter embodiment, the rack enclosure 10 or a plurality thereof are incorporated in an article of furniture constituting, in the illustrative embodiment of FIG. 12, a tiered work station 770 incorporating a plurality of enclosures 200 of reduced size in each of which is mounted a rack 201 slidably mounted on an extensible perforate (697) table or platform 244*a*.

The rack enclosures 10 or enclosures 200 and at least one compartment containing at least one enclosure are distributed in a plurality of tiers; for example, at least one upper tier 774 recessed from the work surface or table top 778; and, illustratively, at least one lower tier 780, usually one tier, disposed beneath the table top. Compartments and the like for retention of books, papers and the like may also be provided.

Attached to the work station 770, at its sides and along its back preferably where they do not impair access to the various enclosures 10 and 200 are the posts 782 at least one and usually several of which are hollow and serve generally the purposes accomplished by the supra modular housing 275, and the riser ducts 290, cable conduit 640 and return conduits 527 disposed therein, of the rack assembly enclosure 10 of FIG. 3. The posts are attached to the ceiling where used for this purpose and to define entry into the ceiling, for example, a conventional hung ceiling, of the facility where the transaction work table 770 is installed to permit interconnection with the heat, ventilation and air-conditioning system and supply and return ducts therein or a dedicated system directed to the needs of the unit 770 or a plurality thereof. The unit 770, in the manner provided with respect to the rack assembly enclosure 10 of FIGS. 1 to 11 may incorporate safety and security systems such as fire detection and fire supression means and the like; and will incorporate emergency access to alternate sources of power and access.

It will be evident that the number of such posts is not critical nor is the number of recesses or the length and number of the tiers in the work station 770.

Computer terminals 230, are, in one embodiment, conveniently maintained for ready access in the enclosures 200 of the upper tier or console section 774 of the unit 770 whereas other data processing components not providing readouts or the like are to be maintained in the rack assemblies 201, incorporated, generally, in the lower tier 780.

Either, or in indeed, additional, tiers may however contain the computer terminals, diminutive computers or microcomputers or the other and well-known components, illustratively, of a microcomputer system. The enclosures of the unit 770 are, generally more diminutive, in any event, where used in the work station 770 than those contemplated herein with respect to the rack enclosure 10 of FIGS. 1 to 11 and have, additionally and usually, a modified closure means 224 (and 225 where present) to occlude the access means 786.

The closure means 224 may be slidable, flexible and segmented and paired to meet at or near the center of the access means or be formed of a single element that closes at the side. The components of the closure means are most desirably adapted to recede into slideways (not shown) arrayed on each, or one side or above each enclosure depending, illustratively, whether, respectively, a paired or single closure means is employed. A closure means 224 may also be adapted to encompass several enclosures in a single tier or multiple tiers in which the access means of the several tiers are in vertical alignment but this approach is ordinarily significantly less preferred in that while it permits a certain economy of construction it will permit unnecessary exposure to the atmosphere of equipment contained in enclosures to which access is not required. It is of course feasible to provide an over-all closure means 225 for each enclosure 200, and, in addition, provide a removable inspection plate to access means requiring infrequent use.

An outer transparent closure means 224 and inner impact resistant, opaque heat refractive closure means 225 is also desirable so that by retraction of the inner closure means 225 the necessary observations can be made of the equipment housed in the rack assembly enclosure 10 or enclosure 20 without opening the enclosure to the ambient atmosphere.

The closure means 224, and where present, 225, may be opened and closed manually using conventional handles 800 or be monitored and controlled mechanically or electrically.

The closure means, and indeed the housing and construction of each enclosure 200 is that described elsewhere herein with reference to FIGS. 1 to 11 hereof and as described in U.S. Pat. No. 4,121,523 and in copending application Ser. No. 952,782 filed Oct. 19, 1978 of which this application is a continuation-in-part; in copending application Ser. No. 912,974 filed June 5, 1978 and copending application Ser. No. 102,552 filed Dec. 12, 1979 by the inventor herein and another, all of which are incorporated by reference herein.

Similarly, the rack 201 with its generally vertical legs 504 and usually horizontal reach bars or ribs 505 are arrayed, as well, in the manner and with the possible variations, and using the materials described above with reference to the embodiments of the invention of FIGS. 1 to 11 hereof.

The duct system including the rack assembly supply ducts 509 shown in FIG. 12 are in like manner included into a system incorporating supply connector ducts 290. The enclosure includes return conduits 527 as, and in the manner described, in FIGS. 1 to 11, and including the components of the supra modular housing 275 mounted on or through the perforate housing partition 274 thereof.

The work station 770 may include cable retention control and metering means as well (not shown) which, with the fluid supply and return means, are integrated in each tier into a generally horizontal collection conduit 792 which connects with the vertical collection ducts 790 formed in certain or all of the posts 782 mounted on the unit 770. These latter ducts 790 join collection ducts 527 to define passage into the hung ceiling 286 and are distributed therethrough in the manner shown, for example, in FIG. 4 hereof, in one embodiment of the invention.

The rack assemblies 201 and contained equipment 230 shown illustratively in the lower tier 780 of FIG. 12 or the contained equipment itself as shown, again illustratively and semi-diagrammatically, in the upper tier 774 of the unit 770 are adapted to linear extention through the access means 786 of each enclosure for maintenance, inspection, repair and the like on the laterally extensible platform 244*a*, an operation made possible by the flexible character of the ducts 509, and the tracks 794 or other means of transport such as ball bearings mounted upon the enclosure base 284.

It is noted that, as with the embodiments of FIGS. 1 to 11 the system of fluid supply and cable management involved in retention and operation of the electronic data processing equipment 230 within the several enclosures 10 can be transmitted through the conduits 790 and 782 to the space provided underneath the floor of the facility or building in which the work station is located, and to power supply and fluid, for example, heat, ventilation, and air-conditioning ducts or dedicated air conditioning units located therein, or adjacent thereto.

A dedicated heating, ventilating and air conditioning or other atmospheric control unit 599 such as shown semi-diagrammatically in FIG. 1 incorporated within the rack assembly enclosure 10 may also be included in the work station 770 of FIG. 12 or a modification thereof.

As previously described, the flow of air or other atmosphere to the rack assemblies 201 of the various rack assembly enclosures 10 is provided through supply connection ducts or plenums 290 as shown in FIG. 12 to rack assembly supply ducts 509. The air or other atmosphere circulated through the legs 504 and ribs 505 of the rack 201 in each instance and exposed to the various data processing equipment components 230, is returned to the atmospheric control unit 599 through return conduits or plenums 527, integrated within the work station housing 770 and connected to the atmospheric control unit 599.

In a preferred embodiment, the atmospheric control unit 599 is adapted to function as a heat exchange unit, removing the heat generated by the electronic equipment 230 returned in the atmosphere flowing through the return conduits or plenums 527 and reconditioning it for flow return through ducts or plenums 290. No "fresh" or external air is required within this system because no human occupant is present within the closed system of the work station 770 or enclosure 10. Only heat loads generated by the equipment 230 housed therein need be removed by the atmospheric control unit 599, achieving a significant advantage in the efficient use of energy. As described elsewhere herein, the heat so generated may be released to the surrounding room environment or into the central building return system.

Also, as described hereinabove, the recycled heat received by the atmospheric control unit 599 is released into the surrounding room environment or into the central building return system.

The enclosures 10 may have a plurality of access and closure means, such as shown in FIG. 4, some of which are adapted to provide optimal access for operation thereof and others to provide optimal service access to the data processing components 230 disposed therein.

Due to the requirements for prevention of the transmission of electromagnetic energy from data processing system components disposed within the work station 770 and indeed, the free standing enclosure 10, especially in the radio frequency band, the use of adequate shielding and attenuation systems within these modules is of great importance as described in copending U.S. application Ser. No. 102,552 filed Dec. 11, 1979 by the inventor herein and application Ser. No. 208,709 filed on even data herewith by the same inventor as a continuation-in-part of application Ser. No. 102,552. The use of the composite panel system described therein, to form the housing members of the work station 770 and the enclosure 10, has the desirable properties of providing a barrier to the transmission of electromagnetic energy as well as to insulate and protect the interior of the enclosure against high temperature conditions. In addition the insulating properties of the composite panel still further improves the energy efficiency of the rack enclosure 10 described herein.

The transmission of computer or electronic communications, signal and power cables in and out of the enclosure 10 and work station 770 is of special importance since the conduit or cable entry areas provided in these enclosures are otherwise very vulnerable to penetration by hostile environmental pollutants such as hot gases, smoke particles, flames and water. The means to protect these interfaces, using intumescent gasket materials is described in the aforesaid copending application Ser. No. 102,552 filed Dec. 11, 1979, and the foregoing continuation-in-part application thereof filed on even date herewith, the disclosures of which are incorporated by reference herein.

It will be evident that in addition, or as an alternative, to electronic data processing equipment, all manner of other sensitive equipment and valuable documents and records may be retained in the enclosures 10 and work stations 770 incorporating these enclosures.

Figure 14:
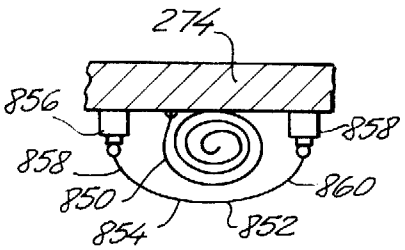
FIG. 14 is a vertical sectional view taken along the lines 14—14 of FIG. 13.

In a preferred embodiment of the invention there is mounted about the periphery of the under surface of the supra modular partition 274 a plurality of folded shrouds 850 made of a flame retardant fabric encased in a release capsule (not shown) or simply retained by a latch assembly 852 adapted to retain the shroud or shrouds in a compact and folded state ready for release in response to security or environmental needs, as shown, more particularly, in FIGS. 1, 13 and 14. The shroud is adapted for release from the capsule or latch assembly 852 to form a curtain (not shown) in response to a monitored control remote from the enclosure 10 or automatically in response to, for example, a sudden or significant rise in temperature or as the result of impinging liquid or contaminating particulate matter in the air such as in the case of smoke. The shrouds are adapted to fall about the outside of the rack assembly 201 and within the enclosing walls and closure means of the enclosure 200. The shrouds, where a plurality are used, are so positioned that the lateral borders of the released shrouds will be in contiguous or overlapping relation.

The latch assembly 852 is adapted to release the shroud cover 850 to fall around the rack 201 under the conditions described hereinabove. The latch assembly 852 may be actuated by a variety of means apparent to one skilled in the art including manual, mechanical, pneumatic, electrical means, or combinations thereof in one preferred embodiment of which, the latch would incorporate a solenoid system adapted to pull the shroud holding element or latch 852 from a friction catch fastener (not shown) on the opposite end of the latch of holding element assembly 852. In any event, the holding element may be fitted with end fasteners which are adapted to attach it to the friction catch and solenoid.

The shroud may be composed of a variety of materials adapted to resist the penetration of heat, water and the like, including but not limited to a mylar film, alone or in a significantly preferred combination in a bonded laminate with a further insulating ply formed of a flexible bonded ceramic fibrous material such as described in the copending applications of one of the inventors herein and another, application Ser. No. 912,974 filed June 5, 1978, application Ser. No. 102,552 filed Dec. 12, 1979, and the continuation-in-part of this latter application filed on even date herewith, and incorporated by reference herein.

The shroud cover 850 may be left covering the equipment in one embodiment and folded away to provide service access or automatically released from a compact, folded or rolled state to cover the rack 201 in the event of an abnormal or emergency condition such as fire or flood.

The shroud retaining element, or retaining bond, or latch 852 is adapted to hold the shroud in its compact state for emergency release as described above. The shroud retaining latch means 852 further comprises a retaining bank which may be a continuous member or intermittant bond or strap 854, holding the shroud cover 850 at intervals. It may further comprise means for the release of said retaining band 852 such as shown in FIGS. 13 and 14. The retaining band may be fastened at one end to a spring loaded or friction latch 856 adapted to release the end 857 of the retaining band upon exertion of the appropriate force. The band 854, thus free, permits the shroud cover 850 to fall about the rack 201. A means of applying the appropriate force to the friction latch 856 may be provided, illustratively, by means of a solenoid 858, shown diagrammatically, attached to the opposite end 860 of the band 854. Retraction of the solenoid 858 will thus exert a force upon the end fasteners or friction latch 856, transmitted through the band 854. The solenoid can be replaced with an equivalent force-generating apparatus activated by electrical, hydraulic, mechanical means or manual means obvious to one skilled in the art.

As noted hereinabove shroud cover 850 is preferably made of a lightweight pliable material which is water resistant and reflective of thermal energy. Among the materials which may be used include multiple ply composites or laminates, non-bonded multiple ply composites and single component fabrics or films as described illustratively in copending application Ser. No. 102,552 filed Dec. 12, 1979, (now U.S. Pat. No. 4,381,716) by the applicant herein and another and the copending continuation-in-part thereof filed on even date herewith (Ser. No. 282,709). A significantly preferred material is a composite comprising an outer, reflective foil ply continuously or intermittantly bonded to at least one ply of ceramic fiber material preferably in a cross-woven blanket fabric or paper form. The outer reflective ply may be eight gauge aluminum or mylar sheet.

In addition, the shroud cover may be adapted in two fluid-tight components which may be inflated to provide a tight seal against the interior of the housing 200 to resist or prevent the entry of contaminates therein. In this embodiment, a rubberized, inflatable inner member may be added to the significantly preferred embodiment described above.

A small dedicated source of gas such as air or nitrogen may be self-contained within the enclosure to provide the requisite inflation, illustrated by the pneumatic reservoir 535 in FIG. 1.

It will be evident that the terms and expression which have been employed are used as terms of description and not of limiation. There is no intention in the use of such terms and expressions of excluding equivalents of the features shown and described or portions thereof and it is recognized that various modifications are possible within the scope of the invention claimed.

What is claimed is:

1. A transaction processing enclosure for housing of electronic data processing equipment and the like comprising, in combination, at least one access means to the interior of said enclosure; closure means registrable with said access means; said enclosure including a frame comprising hollow conduit support members arrayed at spaced intervals to provide a unitary support structure adapted to receive and store said data processing equipment components; a number of said hollow conduit support members being interconnected in a manner such as to distribute a fluid therethrough.

2. A transaction processing enclosure as claimed in claim 1, wherein said hollow conduit support members are adapted to emit said fluid into said enclosure.

3. A transaction processing enclosure as claimed in claim 1, wherein said hollow conduit support elements are adapted to transmit a gaseous fluid.

4. A transaction processing enclosure as claimed in claim 1, comprising, in combination, a turntable adapted to support said frame; and effect rotation thereof within said enclosure.

5. A transaction processing enclosure as claimed in claim 4, wherein said turntable includes a platform movably affixed thereto, upon which said frame is mounted; said platform being adapted to extend in at least one direction and to or beyond said access means.

6. A transaction processing enclosure as claimed in claim 5, wherein means are provided to integrate the opening of the closure means provided in said enclosure with the passage of said movable platform from the interior of said enclosure therethrough.

7. A transaction processing enclosure as claimed in claim 1, wherein said conduit members include ports for emission of gaseous fluid substantially uniformly throughout said enclosure.

8. A transaction processing enclosure as claimed in claim 7, wherein said fluid is a coolant medium so that the interior of said enclosure is maintained at a uniform temperature throughout.

9. A transaction processing enclosure as claimed in claim 1, wherein said frame comprises a lattice of interconnecting and spaced hollow conduit support members.

10. A transaction processing enclosure as claimed in claim 9, wherein said lattice comprises a plurality of substantially horizontal conduit members and substantially vertical members interconnected in a manner to distribute a gaseous fluid through said frame.

11. A transaction processing enclosure as claimed in claim 1, wherein said enclosure includes fluid inlet means connected to a fluid distributor manifold located within said enclosure and separated from said frame but interconnected therewith through a plurality of extensible conduits.

12. A transaction processing enclosure as claimed in claim 1, wherein said spaced conduit members are randomly spaced.

13. A transaction processing enclosure as claimed in claim 1, wherein said spaced conduits members are regularly spaced.

14. A transaction processing enclosure as claimed in claim 7, wherein means in the form of ports are provided for emission of fluid from said frame into said enclosure; and said ports are present in greater frequency at the upper end of said frame to accommodate the tendency of warm gaseous fluids to rise within said enclosure.

15. A transaction processing enclosure as claimed in claim 11, wherein said distributor manifold is fixedly mounted within said enclosure and said frame is adapted to rotate within said enclosure and for lateral movement therein.

16. A transaction processing enclosure as claimed in claim 15, wherein said conduits are extensible and flexible.

17. A transaction processing enclosure as claimed in claim 1, wherein said enclosure includes means for removal of fluid from the interior of said enclosure.

18. A transaction processing enclosure as claimed in claim 1, wherein said enclosure includes means for passage of electrical cables between the exterior and interior of said enclosure.

19. A transaction processing enclosure as claimed in claim 18, wherein said means for passage of electrical cables includes means for holding excess lengths of cable under a predetermined resilient load whereby said cables are able to move in a preselected path for storage in response to movement of the components to which said cables are connected and which are stored in said enclosure.

20. A transaction processing enclosure as claimed in claim 1, wherein said enclosure includes means for holding, transmitting and distributing electrical cables connecting the equipment components contained within said frame in said enclosure with a power source external to said enclosure under a predetermined resilient load which permits the contained equipment components to be moved with said cables intact without applying to said cables a tensional load such as to interrupt the electrical connection between said components and said power source.

21. A transaction processing enclosure as claimed in claim 1, wherein said enclosure includes means for holding an excess length of cable connecting said equipment components contained therein in electrical contact with a power source outside of said enclosure and distributing said cables in a tortuous path under a predetermined resilient load which enables the components to which the cables are connected to be moved within said enclosure on said frame to a position outside of said enclosure without at the same time applying to said cables a tensional stress which may interrupt electrical contact between said equipment components and said power source.

22. A transaction processing enclosure as claimed in claim 1, wherein said cable transmitting means permits said equipment components to be moved with said cables intact but under a tensional load which may not exceed the fracture point of said cables.

23. A transaction processing enclosure as claimed in claim 1, wherein said closure means has outer surface conformance in size and shape with and registrable with said access means, said closure means being slidably mounted and movable with respect to said access means to effect the closing and opening thereof; turntable means mounted independently with respect to said closure means, and adapted to rotate therewith; said turntable being rotatably secured within said enclosure and capable of supporting said frame and said equipment components stored within said frame thereon, so that the entire periphery of said turntable means, frame, and supported equipment components are accessible through said access means for providing controlled environmental conditions for the operation, maintenance and security of said equipment components within the interior of said enclosure, and control means interacting with said closure means to alternately provide access or non-accessibility to the equipment components disposed within said frame in said enclosure from the exterior of said enclosure; and for activating said closure means to effect access or non-accessibility.

24. A transaction processing enclosure as claimed in claim 23, wherein said control means is adapted to effect access or non-accessibility to said equipment components within said enclosure in response to said environmental conditions of operation, maintenance or security.

25. An article of furniture comprising at least one tier of a plurality of transaction processing enclosures for housing of electronic data processing equipment, components thereof and the like wherein each of said enclosures comprise, in combination, at least one access means to the interior of said enclosure; closure means registrable with said access means; said enclosure including a frame comprising hollow conduit support members arrayed at spaced intervals to provide a unitary support structure adapted to receive and store said data processing equipment and components thereof; a number of said hollow conduit support members being interconnected in a manner such as to permit distribution of a fluid therethrough for contact with said equipment and components.

26. An article of furniture as claimed in claim 25, wherein hollow conduits are incorporated for transmitting gaseous fluid from a source exterior to said article of furniture to the hollow conduit support members of said frame.

27. A transaction processing enclosure for housing of electronic data processing equipment and the like comprising, in combination, at least one access means to the interior of said enclosure; closure means registrable with said access means; said enclosure including a frame comprising hollow conduit support members arrayed at spaced intervals to provide a unitary support structure adapted to distribute a fluid therethrough and provide a controlled environment to equipment mounted on said frame within said enclosure.

28. A transaction processing enclosure as claimed in claim 27, comprising, in combination, a rack assembly mount adapted to support said frame within said enclosure.

29. A transaction processing enclosure as claimed in claim 28, wherein said rack assembly mount includes a platform movably affixed thereto, upon which said frame is mounted; said platform being adapted to extend in at least one direction and to or beyond said access means.

30. A transaction processing enclosure as claimed in claim 1 wherein at least one flexible sheet is attached at one end to the upper end of said housing in a compacted static frame disposed within said housing.

31. A transaction processing enclosure as claimed in claim 1 wherein said hollow conduit support members include ports for emission of gaseous fluid from said frame into said enclosure; and wherein said enclosure includes means for removal of fluid from said enclosure.

32. A transaction process enclosure as claimed in claim 3, wherein said transaction processing enclosure includes means for restoring said fluid to a state as to composition and temperature approximating that in which it was previously emitted from said ports into said enclosure and for recycling of said fluid through said conduit support members, ports and enclosures.

33. A transaction processing enclosure for housing of data processing equipment and the like comprising, in combination, an enclosure and a frame disposed therein and comprising hollow conduit members the lengths of which are arranged in spaced parallel and angular relation to one another and continuous with each other to provide a unitary support structure adapted to receive and support said data processing equipment and the like; the interior of a plurality of said conduit members being interconnected in a manner such as to distribute a fluid through said members, and from said members into the surrounding environment within said enclosure.

* * * * *